US010918931B2

(12) United States Patent
Myre

(10) Patent No.: US 10,918,931 B2
(45) Date of Patent: Feb. 16, 2021

(54) CRADLE FOR SUPPORTING FREE WEIGHT ASSEMBLY

(71) Applicants: VINTAGE GOLD HOLDINGS LIMITED, North Point (HK); Jake Myre, Beaver Dam, WI (US)

(72) Inventor: Jake Myre, Beaver Dam, WI (US)

(73) Assignee: VINTAGE GOLD HOLDINGS LIMITED, North Point (HK)

( * ) Notice: Subject to any disclaimer, the term of this patent is extended or adjusted under 35 U.S.C. 154(b) by 0 days.

(21) Appl. No.: 15/546,087

(22) PCT Filed: Feb. 23, 2015

(86) PCT No.: PCT/US2015/017047
§ 371 (c)(1),
(2) Date: Jul. 25, 2017

(87) PCT Pub. No.: WO2016/137428
PCT Pub. Date: Sep. 1, 2016

(65) Prior Publication Data

US 2018/0008878 A1 Jan. 11, 2018

(51) Int. Cl.
*A63B 71/00* (2006.01)
*A63B 21/075* (2006.01)
(Continued)

(52) U.S. Cl.
CPC ..... *A63B 71/0036* (2013.01); *A63B 21/063* (2015.10); *A63B 21/075* (2013.01);
(Continued)

(58) Field of Classification Search
CPC ..... A63B 71/0036; A63B 21/0728; A63B 23/03541; A63B 21/0726; A63B 21/075;
(Continued)

(56) References Cited

U.S. PATENT DOCUMENTS 5,769,762 A * 6/1998 Towley, III ..... A63B 21/0605 482/107
6,039,678 A * 3/2000 Dawson ..... A63B 21/0728 482/104
(Continued)

FOREIGN PATENT DOCUMENTS

CN 2262438 Y 9/1997
WO 2012/058612 A1 5/2012
WO 2014065827 A1 5/2014

OTHER PUBLICATIONS

International Search Report and Written Opinion for PCT Application No. PCT/US2015/017047, dated Oct. 16, 2015, 11 pages.
(Continued)

*Primary Examiner* — Andrew S Lo
(74) *Attorney, Agent, or Firm* — Stinson LLP

(57) ABSTRACT

A cradle for supporting an adjustable free weight assembly that includes first and second weight plate sets. End walls and side walls of the cradle define a cavity sized to receive the free weight assembly. The end walls engage plate portions and locking element portions of outermost weight plates of the free weight assembly when received in the cradle. Inboard surfaces of the side walls engage portions of weight plates in at least the first weight plate set to substantially inhibit the first weight plate set from moving vertically or laterally between the side walls. The configuration of the inboard surfaces of the side walls aligns the weight plates in the first weight plate set both vertically and horizontally so that central openings in the weight plates for receiving a selector shaft are substantially concentric.

20 Claims, 23 Drawing Sheets

(51) Int. Cl.
*A63B 21/072* (2006.01)
*A63B 23/035* (2006.01)
*A63B 21/062* (2006.01)
*A63B 21/00* (2006.01)

(52) U.S. Cl.
CPC ..... *A63B 21/0726* (2013.01); *A63B 21/0728* (2013.01); *A63B 23/03541* (2013.01); *A63B 21/00065* (2013.01)

(58) Field of Classification Search
CPC ..... A63B 21/00; A63B 21/06; A63B 21/0601; A63B 21/072; A63B 21/0724
See application file for complete search history.

(56) References Cited

U.S. PATENT DOCUMENTS 7,153,244 B2 * 12/2006 Towley, III ..... A63B 21/0605 482/108
7,534,198 B1 5/2009 Strong
7,578,771 B1 * 8/2009 Towley, III ..... A63B 1/04 482/106
8,007,415 B1 8/2011 Lundquist
D743,713 S * 11/2015 Flick ..... D6/552
9,814,922 B2 * 11/2017 Moran ..... A63B 21/075
9,895,572 B2 * 2/2018 Donato ..... A63B 21/078
2004/0162198 A1 * 8/2004 Towley, III ..... A63B 21/0605 482/107
2004/0259697 A1 * 12/2004 Whetstone ..... A63B 71/0036 482/94
2005/0009671 A1 * 1/2005 Hummer, Jr. ..... A63B 71/0036 482/94
2005/0277525 A1 * 12/2005 Liu ..... A63B 21/0728 482/107
2006/0135328 A1 6/2006 Doudiet
2006/0205573 A1 9/2006 Savage
2007/0049472 A1 * 3/2007 Hummer, Jr. ..... A63B 71/0036 482/104
2008/0064575 A1 * 3/2008 Towley, III ..... A63B 21/075 482/107
2008/0070759 A1 * 3/2008 Chaulk ..... A63B 21/078 482/104
2009/0124470 A1 * 5/2009 Yu ..... A63B 21/075 482/107
2009/0305851 A1 * 12/2009 Sukup ..... A63B 21/078 482/104
2010/0304938 A1 12/2010 Olson
2010/0304939 A1 * 12/2010 Svenberg ..... A63B 21/0728 482/108
2010/0323855 A1 * 12/2010 Towley, III ..... A63B 21/0605 482/107
2011/0092345 A1 4/2011 Svenberg et al.
2011/0245048 A1 * 10/2011 Nalley ..... A63B 21/0615 482/107
2012/0021877 A1 * 1/2012 Lundquist ..... A63B 21/0728 482/107
2012/0157271 A1 6/2012 Bauer
2012/0309597 A1 * 12/2012 Liu ..... A63B 21/0726 482/107
2013/0288859 A1 * 10/2013 Watterson ..... A63B 24/0062 482/8
2014/0349820 A1 * 11/2014 Wang ..... A63B 21/075 482/108
2015/0297936 A1 * 10/2015 Madden ..... A63B 21/0726 482/107
2015/0367163 A1 * 12/2015 Moran ..... A63B 21/075 482/108
2015/0367164 A1 * 12/2015 Myre ..... A63B 21/0726 482/107
2016/0166873 A1 * 6/2016 Liu ..... A63B 21/0726 482/107

OTHER PUBLICATIONS

Chinese Office action for Application No. 201580074764.8, dated Dec. 11, 2018, 11 pages, with English translation.
Japanese Office action for Application No. 2017-540734, dated Jan. 22, 2019, 16 pages, with English translation.
Supplementary European Search Report issued for EP15883527 dated Sep. 18, 2018, 7 pages.
Canadian Examination Search Report, Application No. 2976760, dated Apr. 10, 2019, pp. 3.
Chinese Office Action, Application No. 20150074764.8, dated Jul. 9, 2019, pp. 13.
Indian Office Action, Application No. 20171702728, dated Oct. 13, 2019, pp. 8.

* cited by examiner

CRADLE FOR SUPPORTING FREE WEIGHT ASSEMBLY

CROSS-REFERENCE TO RELATED APPLICATION

This application is a 371 National stage of PCT Application Number PCT/US2015/017047, filed Oct. 16, 2015, the entire contents of which are incorporated herein by reference.

FIELD

The present disclosure generally relates to a structure for supporting a free weight assembly and more specifically to a cradle for aligning the weight plates of an adjustable free weight assembly.

BACKGROUND

Adjustable free weight assemblies include mechanisms for selectively securing weight plates to a handle. Accordingly, in normal use different number of weight plates will be attached to the handle at a given time, depending on the weight selected. The weight plates not selected remain in a holder after the selected weight plates are removed. In order to select a different number of weight plates the weight assembly is placed back in the holder. In some weight plate assemblies a selector shaft is extended to capture additional weight plates or retracted to release weight plates from attachment to the handle. Typically the weight plates include openings for receiving a portion of the selector shaft. If the weight plates or openings are misaligned, the operation of the selection mechanism can be obstructed.

SUMMARY

In one aspect, a cradle supports an adjustable free weight assembly in a cradled position. The free weight assembly comprises first and second weight plate sets comprising a plurality of weight plates. Each weight plate comprises a plate portion and a locking element for selectively securing the weight plate to an adjacent weight plate. Each weight plate further comprises a central opening for receiving a selector shaft of the free weight assembly for retaining the weight plate to the free weight assembly. The cradle comprises first and second end walls spaced apart from one another along a longitudinal axis of the cradle and partially defining a cavity sized to receive the free weight assembly therein in the cradled position such that the first weight plate set is located adjacent the first end wall and the second weight plate set is located adjacent the second end wall. Each of the first and second end walls comprises a plate-engaging portion and a locking element-engaging portion extending longitudinally inward from the plate-engaging portion. The plate-engaging portion of each end wall is shaped and arranged to engage the plate portion of an outermost one of the weight plates in the respective weight plate set, and the locking element-engaging portion is shaped and arranged to engage the locking element of the respective outermost one of the weight plates when the free weight assembly is in the cradled position. The engagement between the first and second end walls and the outermost plates of the first and second weight plate sets substantially inhibits the adjustable free weight assembly from moving along the longitudinal axis from the cradled position. First and second side walls are spaced apart from one another along a lateral axis of the cradle and extend generally parallel to the longitudinal axis of the cradle to further define the weight assembly cavity. The first and second side walls each have top and bottom edges and an inboard surface extending between the top and bottom edges. The inboard surface slopes laterally inwardly as it extends from adjacent the top edge toward the bottom edge. The inboard surfaces of the first and second side walls are adapted to engage portions of at least the first weight plate set to substantially inhibit the first weight plate set from moving parallel to the lateral axis and toward the bottom edges of the first and second side walls. The configuration of the inboard surfaces of the first and second side walls aligning the weight plates both vertically and horizontally so that the central openings are substantially concentric.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
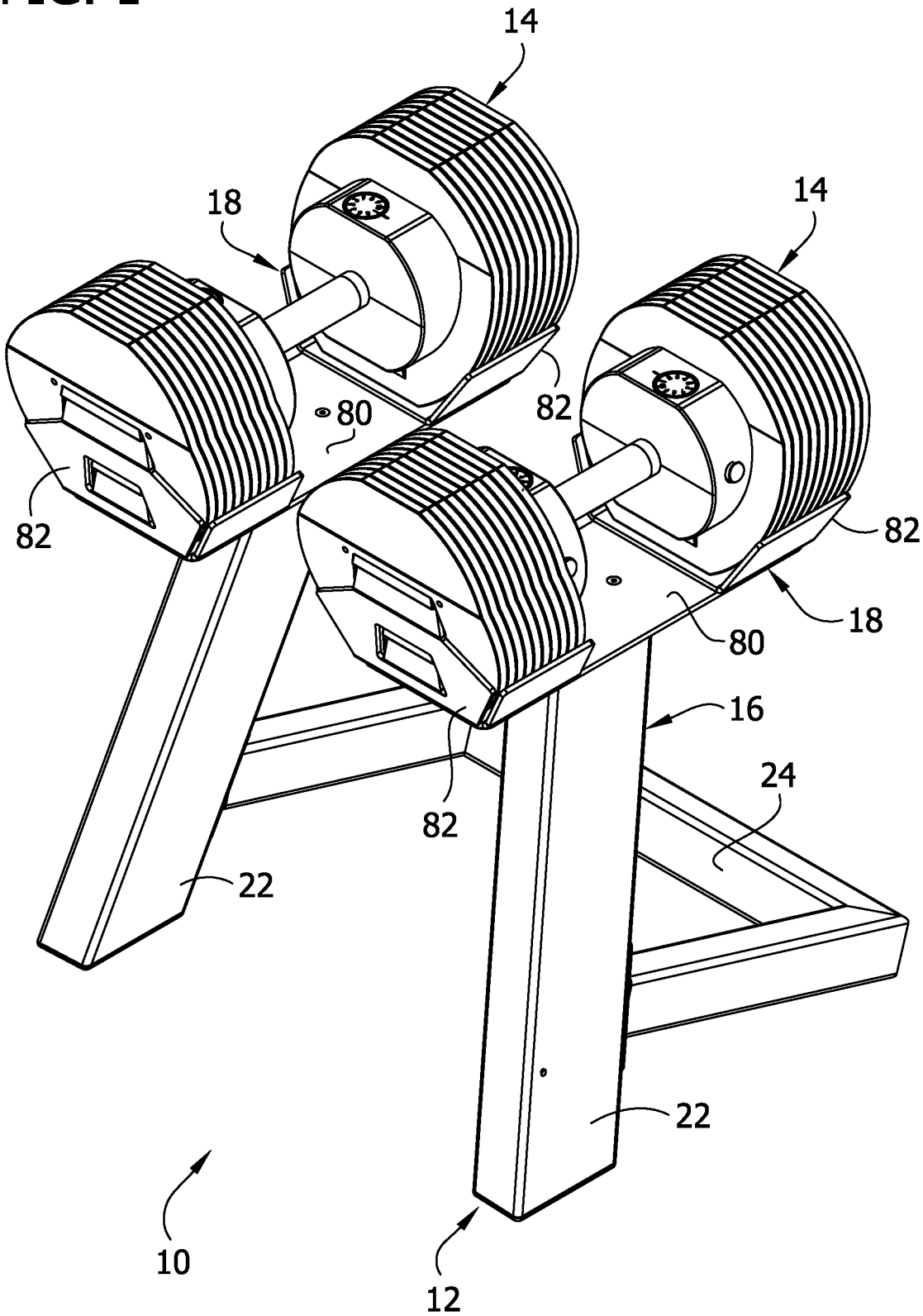
FIG. 1 is a perspective of an adjustable free weight system.
Figure 2:
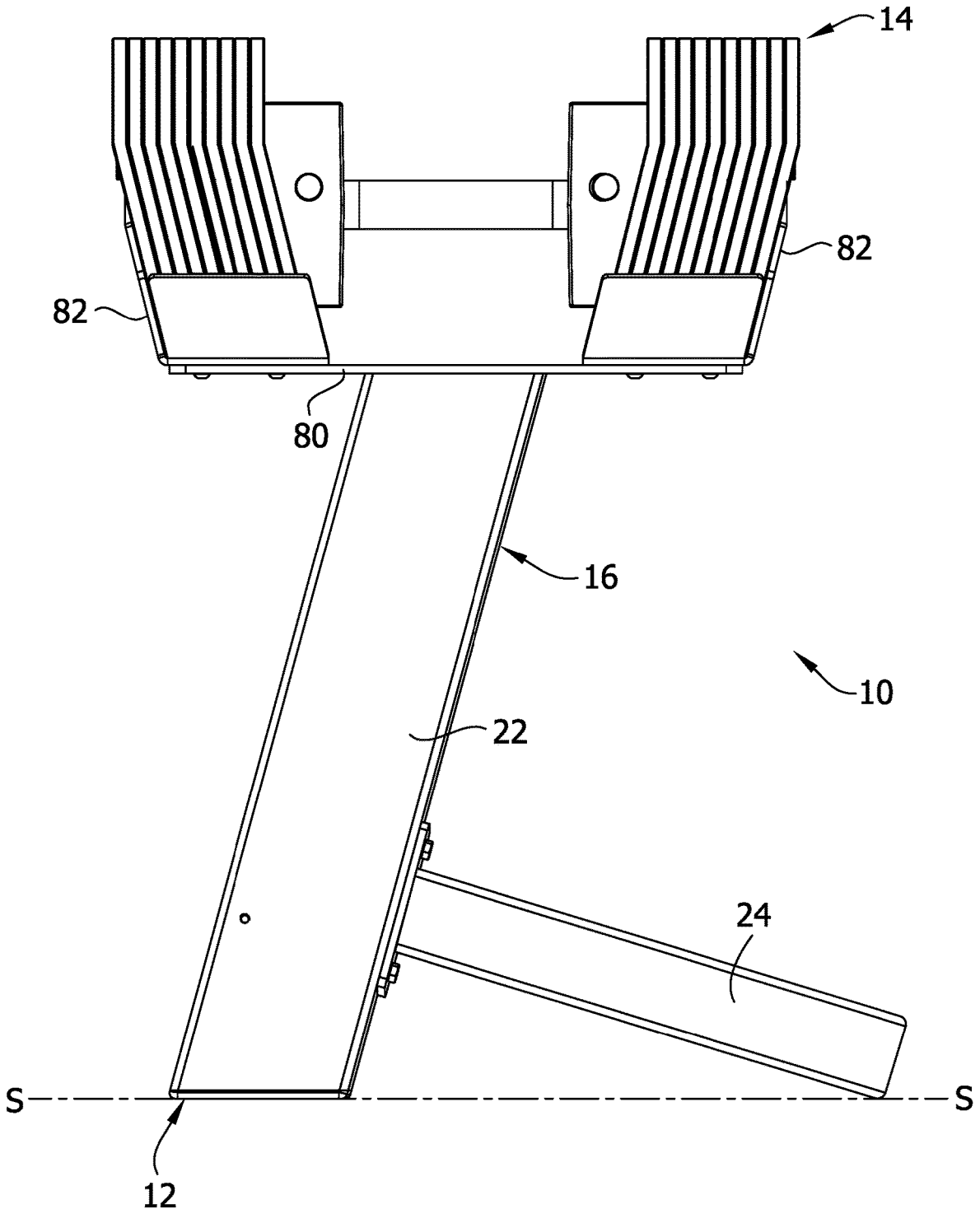
FIG. 2 is a side elevation of the adjustable free weight system.
Figure 3:
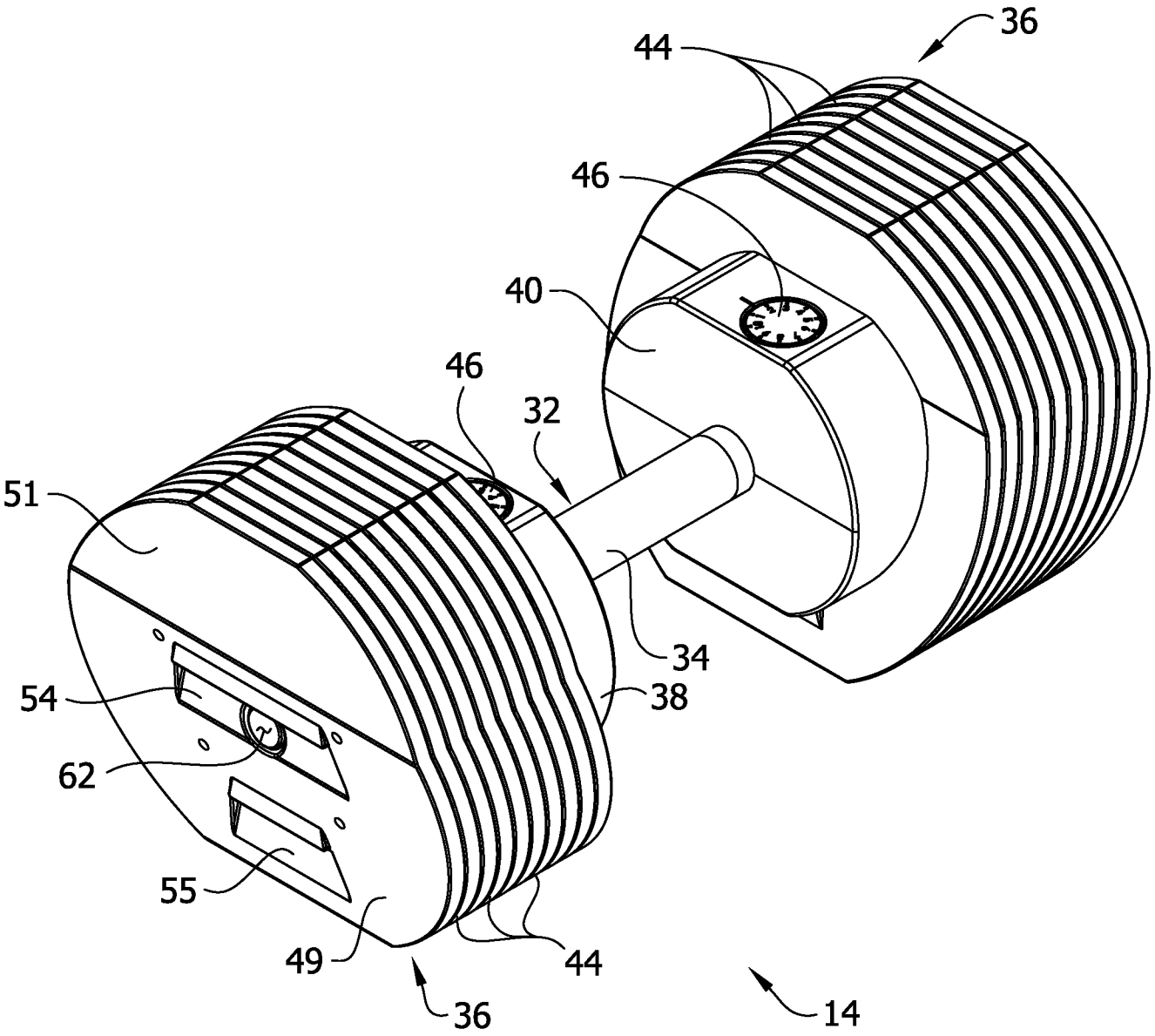
FIG. 3 is a perspective of a dumbbell assembly of the free weight system.
Figure 4:
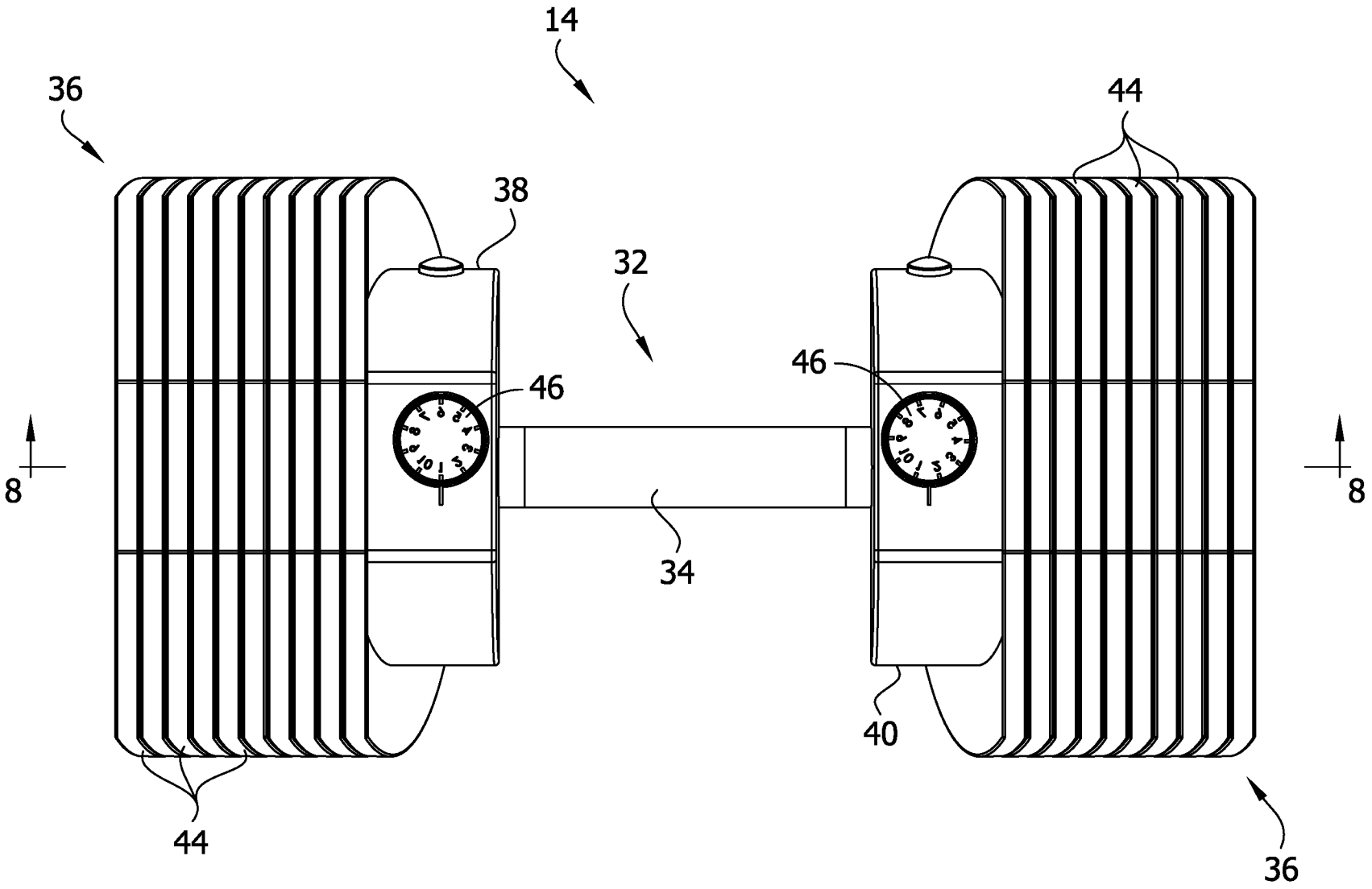
FIG. 4 is a top plan view of the dumbbell assembly.
Figure 5:
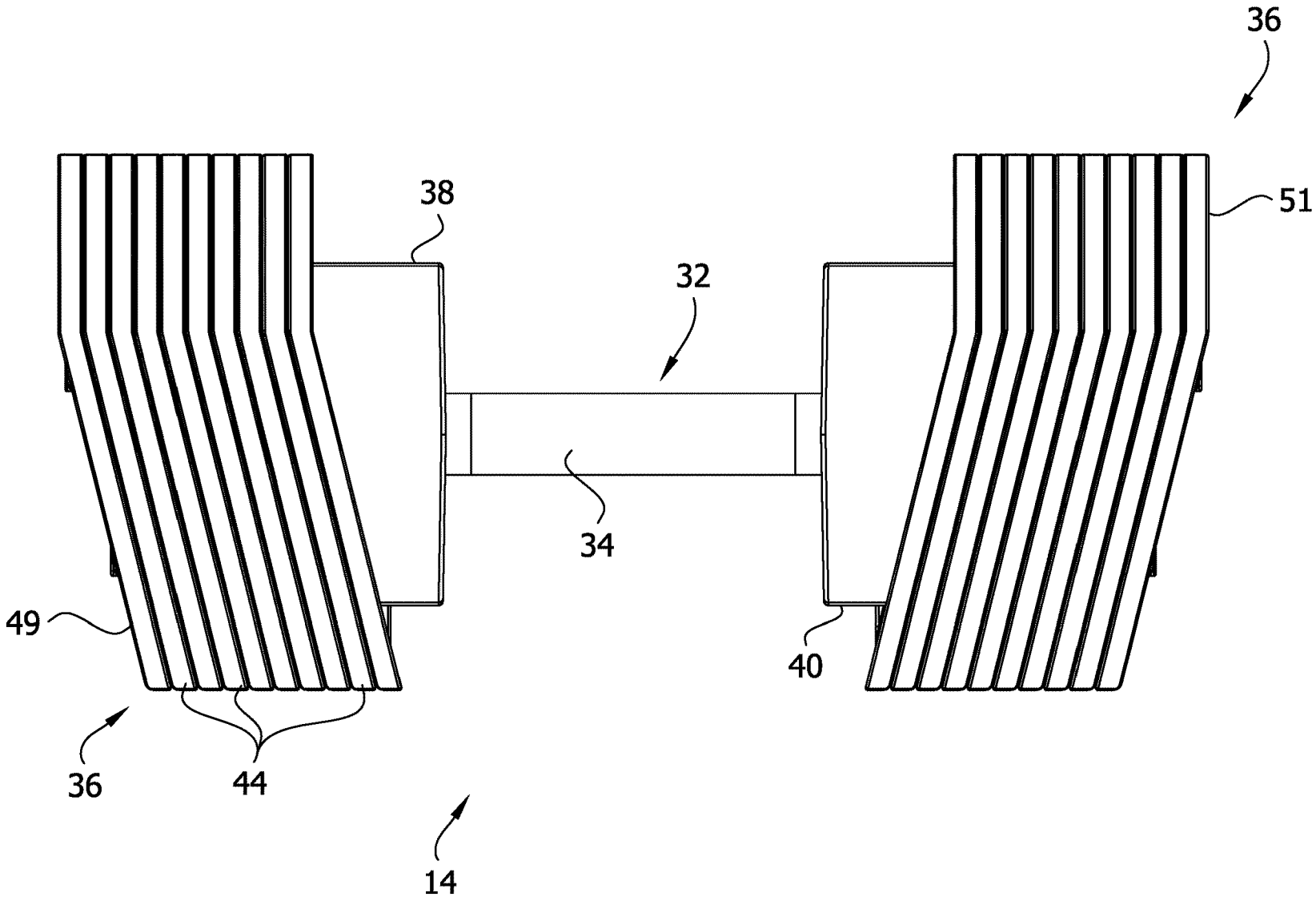
FIG. 5 is a side elevation of the dumbbell assembly.

Referring now to FIGS. 1 and 2, an adjustable free weight system is generally indicated at reference number 10. The free weight system 10 includes a stand 12 that is configured to support a pair of adjustable dumbbell assemblies 14 (broadly, adjustable free weight assemblies). The stand includes a lower base frame 16 and two cradles 18 for receiving the dumbbell assemblies 14. As will be apparent, when a dumbbell assembly 14 is placed into a cradle 18, the cradle, by virtue its shape and arrangement, uses the weight of the dumbbell assembly to repeatably and automatically align components of the dumbbell assembly to allow for selectively adding or removing weight from the dumbbell assembly. In addition, the cradle 18 inhibits movement of the dumbbell assembly 14 or its components to ensure consistent alignment of the components.

The cradles 18 are secured to the lower base frame 16. In the illustrated embodiment, the base frame 16 includes a pair of legs 22 that extend from the cradles 18 to an underlying support surface S. The legs 22 angle slightly rearward as they extend up from the underlying support surface S. A rear support sub-frame 24 extends rearward and downward from the legs 22 to engage the underlying support surface S to hold the legs 22 and cradles 18 upright. In the illustrated embodiment, the cradles 18 are attached to the stand 12 so that the dumbbell assemblies 14 are oriented parallel to the underlying support surface S when received in the cradles.

Referring to FIGS. 3-6, each of the dumbbell assemblies 14 includes a handle assembly 32 including a tubular handle 34 and a pair of collars 38, 40 mounted on respective ends of the handle. A pair of weight plate sets 36 is supported by the handle assembly 32. Each weight plate set 36 comprises a plurality of weight plates 44 arranged in mating sequence between respective collars 38, 40 and outermost weight plates. A knob 46 (broadly, "a selector element") is mounted on each collar 38, 40 to adjust the number of weight plates 44 in each respective set 36 supported by the handle assembly 32 for varying the total weight of the dumbbell assembly 14. A portion of the handle 34 extends between the collars 38, 40 for allowing a user to grasp and manipulate the dumbbell assembly 14.

Figure 7:
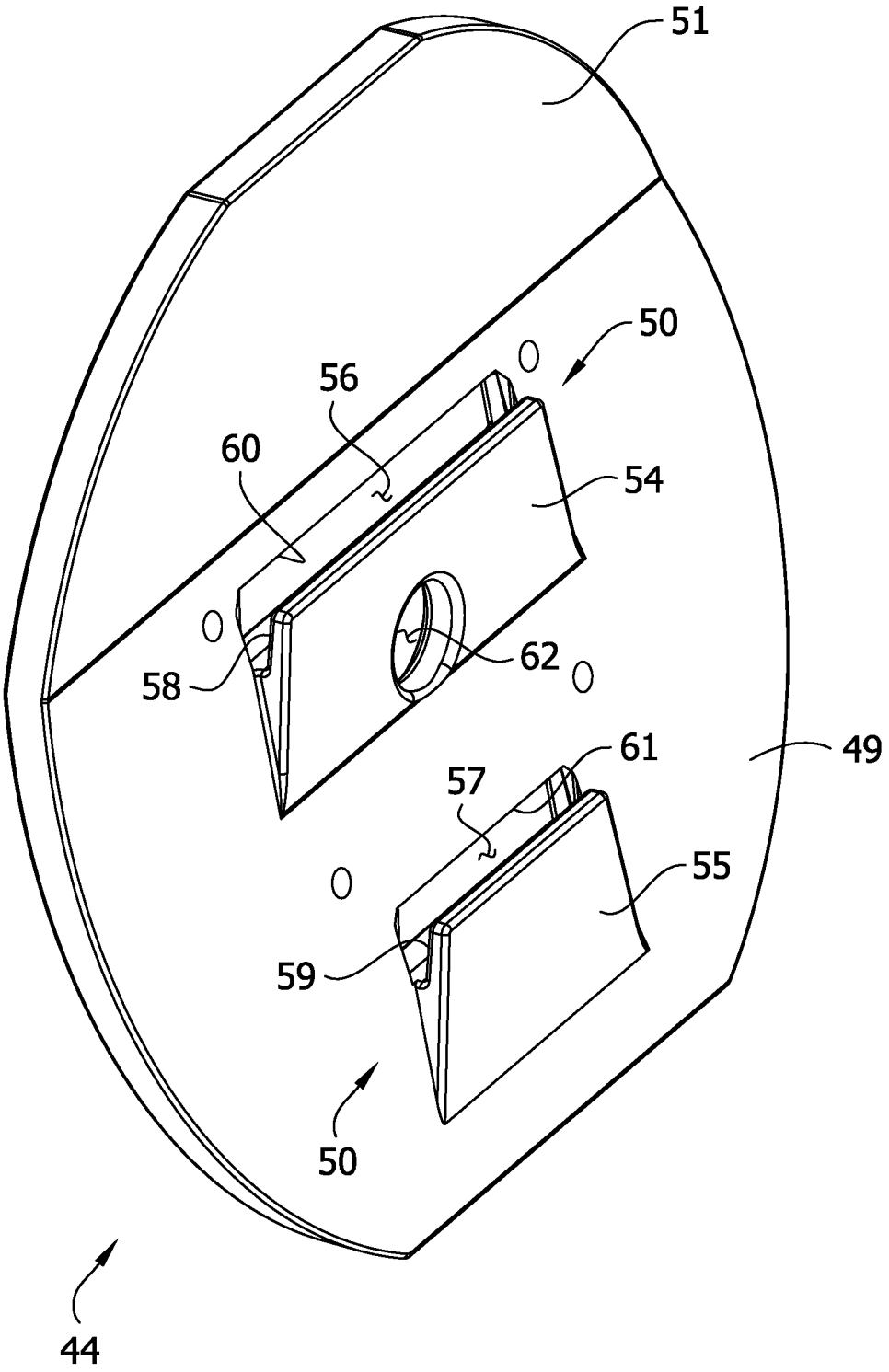
FIG. 7 is a perspective of a weight plate of the dumbbell assembly.
Figure 7A:
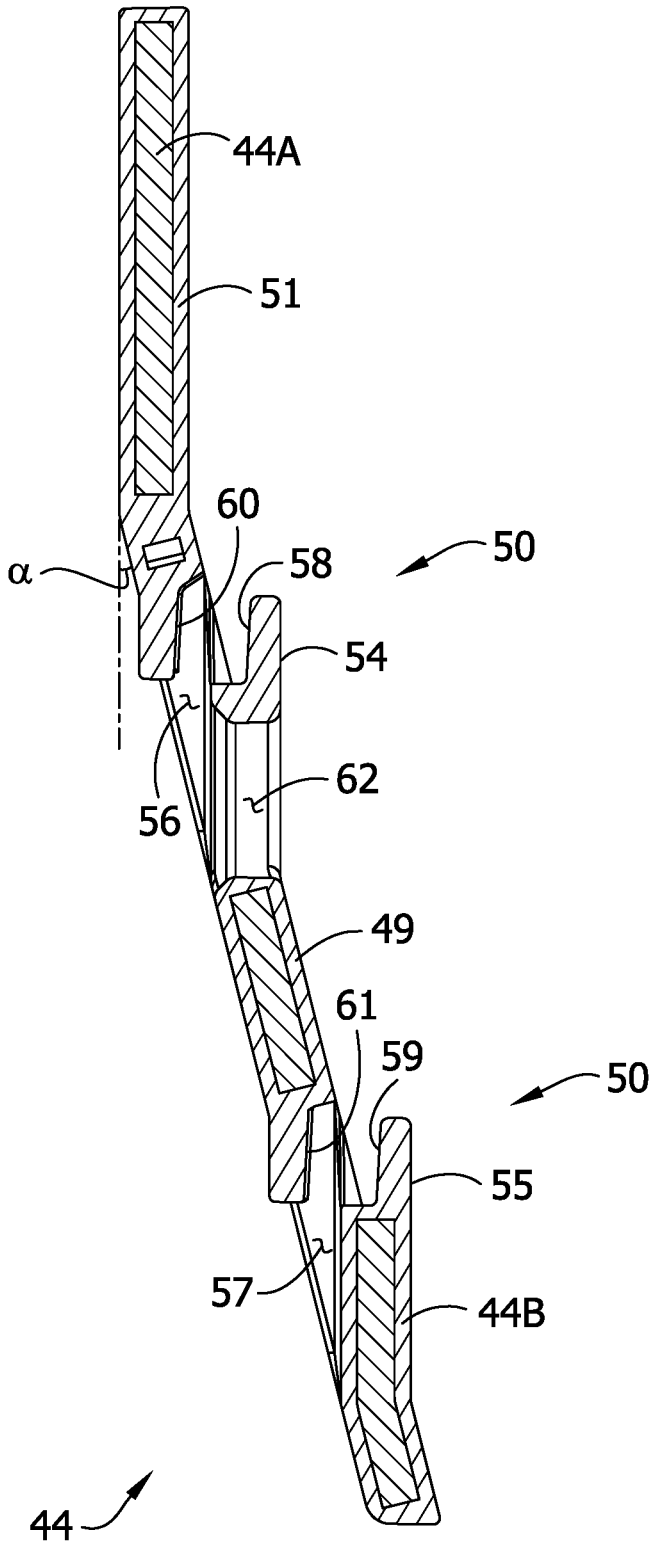
FIG. 7A is a vertical section of the weight plate.

Referring to FIG. 7, each weight plate 44 comprises a main body portion 49 and a top bent portion 51 extending from the main body portion at a skewed angle. Together the main body portion 48 and top bent portion 51 form a plate portion of the plate 44. As shown in FIG. 7A, the weight plate 44 has core 44A made of a suitable material such as steel that is overmolded with a coating 44B of another, safer material such as plastic. In a preferred embodiment, the top bent portion 51 is skewed from the main body portion 49 by an angle $\alpha$ of about 14°. This configuration of the weight plates 44 reduces the overall length of the dumbbell assembly 14 as compared to weight plates without a bend. As a result, the shape of the weight plates 44 creates a more compact dumbbell assembly 14, which makes it easier to manipulate. To enhance interoperation with the cradles 18, the lower portion of each of the weight plates 44 preferably has a tapered shape that narrows as it extends toward the bottom end. The weight plates 44 may have other shapes and configurations without departing from the scope of the present invention. For instance, the weight plates could be substantially round. Moreover, the plates could have a different bend or be flat.

Figure 6:
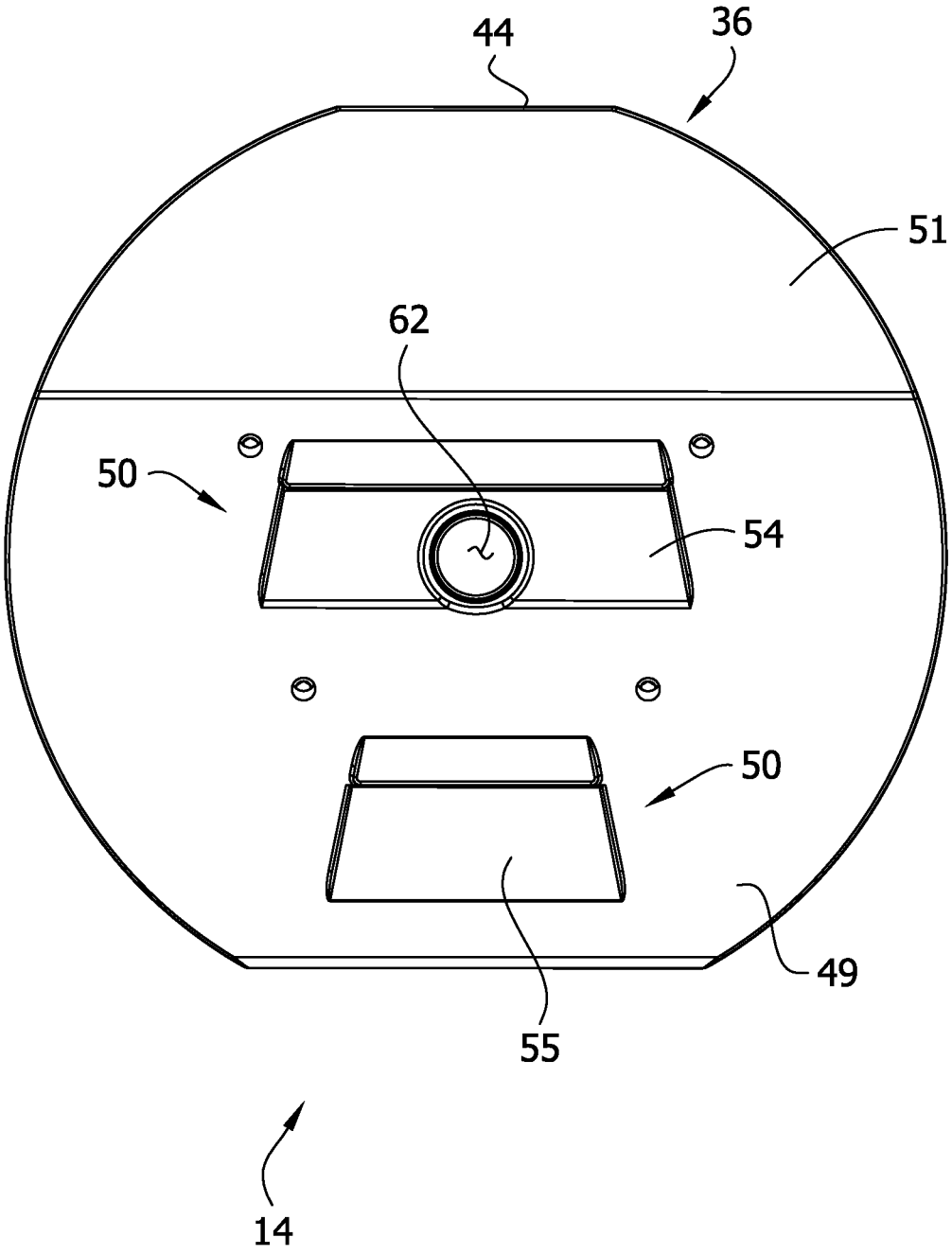
FIG. 6 is an end elevation of the dumbbell assembly.

The weight plates 44 are designed to lock together in sequence from the collar 38, 40 toward the outermost weight plate. Referring to FIGS. 6-7A, the weight plates 44 each have plate locking mechanisms 50 for attaching to adjacent plates. Specifically, the locking mechanisms 50 function to lock two adjoining weight plates 44 together. The locking mechanisms 50 include a central locking tang 54 and a lower locking tang 55 (broadly, locking elements), each formed by making a cut in each of the plates 44. The area inside each cut is bent inward from the plate portion of the plate 44 along a tang bend at an angle, forming the locking tangs 54, 55. The void left by the tang 54 forms a central locking slot 56, and the void left by the tang 55 forms a lower locking slot 57. In the illustrated embodiment, the tangs 54, 55 have an isosceles trapezoidal shape. However, the tang 54 could have other shapes such as non-isosceles trapezoidal, triangular, rectangular or semi-circular without departing from the scope of the present invention. As such, any number of straight or curved cuts could be used to form the tang.

The locking tangs 54, 55 are designed to facilitate locking and unlocking of the weight plates 44 during use of the dumbbell assembly 14. The top end portion of each tang 54, 55 has a locking surface 58, 59. The locking surfaces 58, 59 are designed to engage and lock into an opposed locking surface 60, 61 of a respective locking slot 56, 57 of an inner adjacent weight plate 44. This method of construction allows for the necessary positioning of the locking tangs 54, 55 with respect to respective adjoining locking slots 56, 57, while providing a mechanism that allows for the placement of a plurality of weight plates 44 flush up against one another. In the illustrated embodiment, the locking surfaces 58, 59 form an outwardly facing shoulder portion at the top end of each of the tangs 54, 55 and the locking surfaces 60, 61 form a corresponding inwardly facing shoulder portion at the top end of each of the slots 56, 57. The outwardly facing shoulder portions 58, 59 of the tangs 54, 55 are shaped and arranged for mating engagement with the inwardly facing shoulder portions 60, 61 of the slots 56, 57 of the inner adjacent weight plate 44 when the weight plate is arranged in a weight plate set 36. It will be understood that other locking mechanisms or no locking mechanism may be used within the scope of the present invention.

Figure 8A:
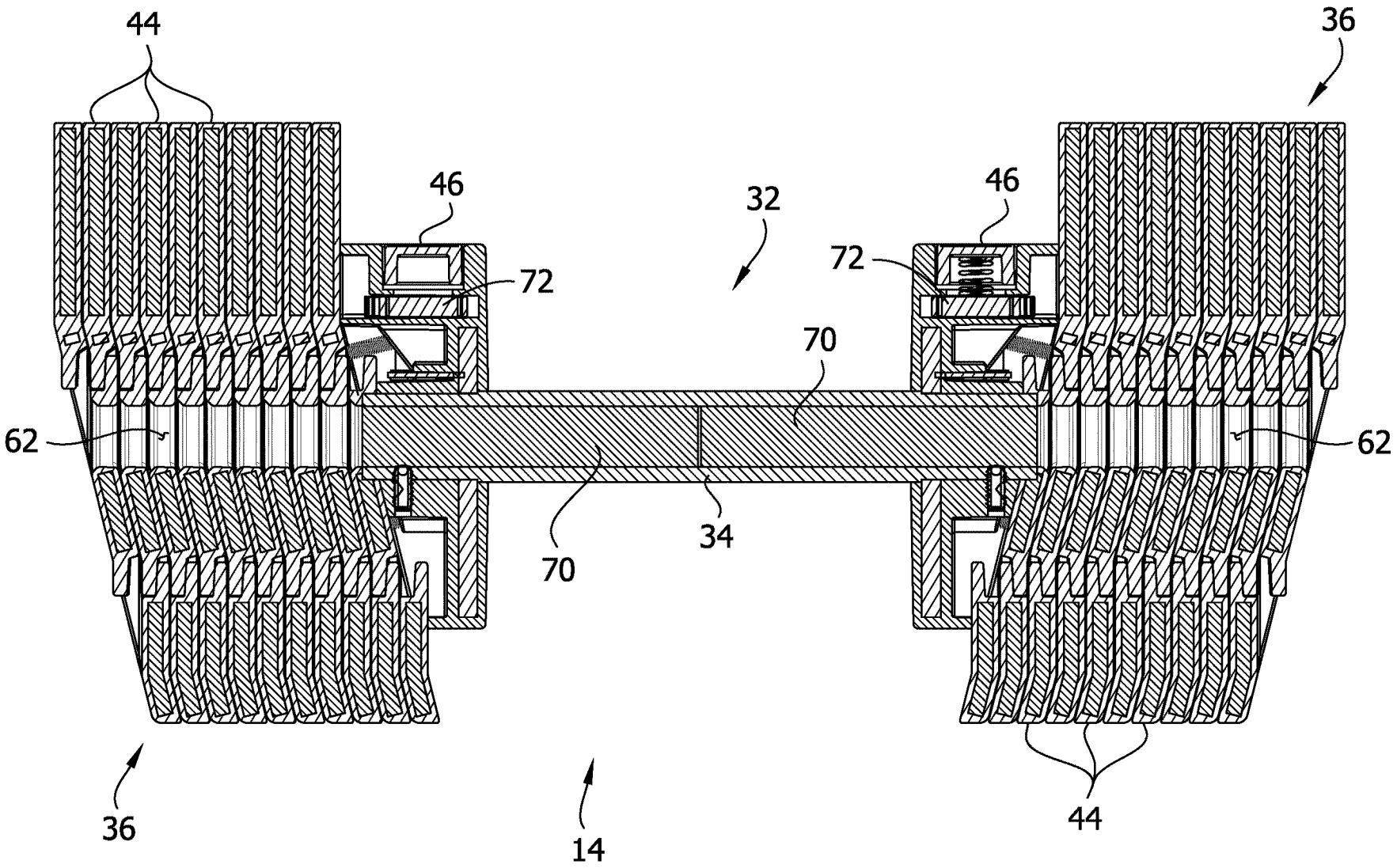
FIG. 8A is a section taken in the plane of line 8-8 of FIG. 4, illustrating selector shafts of the dumbbell assembly in an inward position.
Figure 8B:
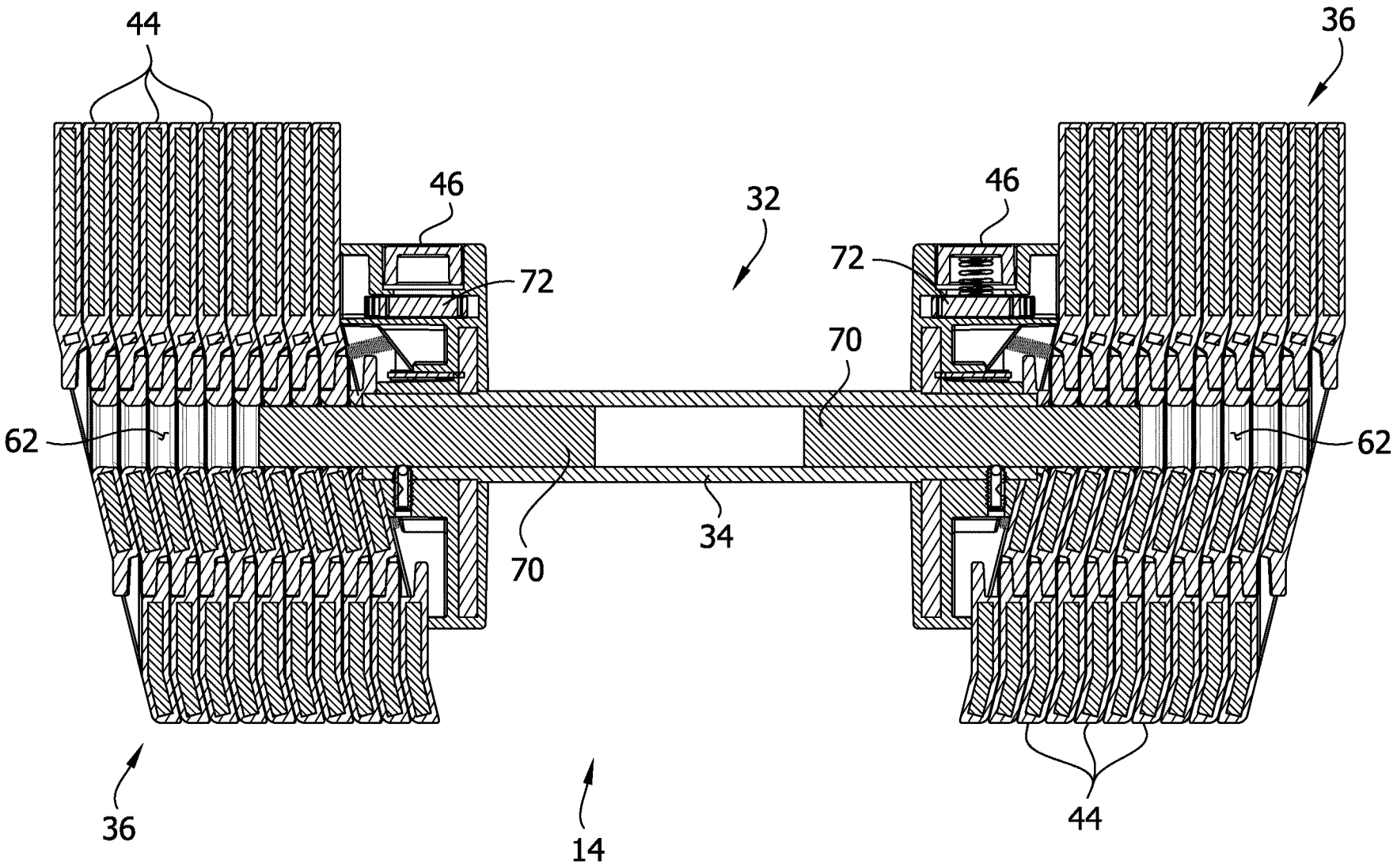
FIG. 8B is another section taken in the plane of line 8-8, illustrating the selector shafts in a more outward position.
Figure 9:
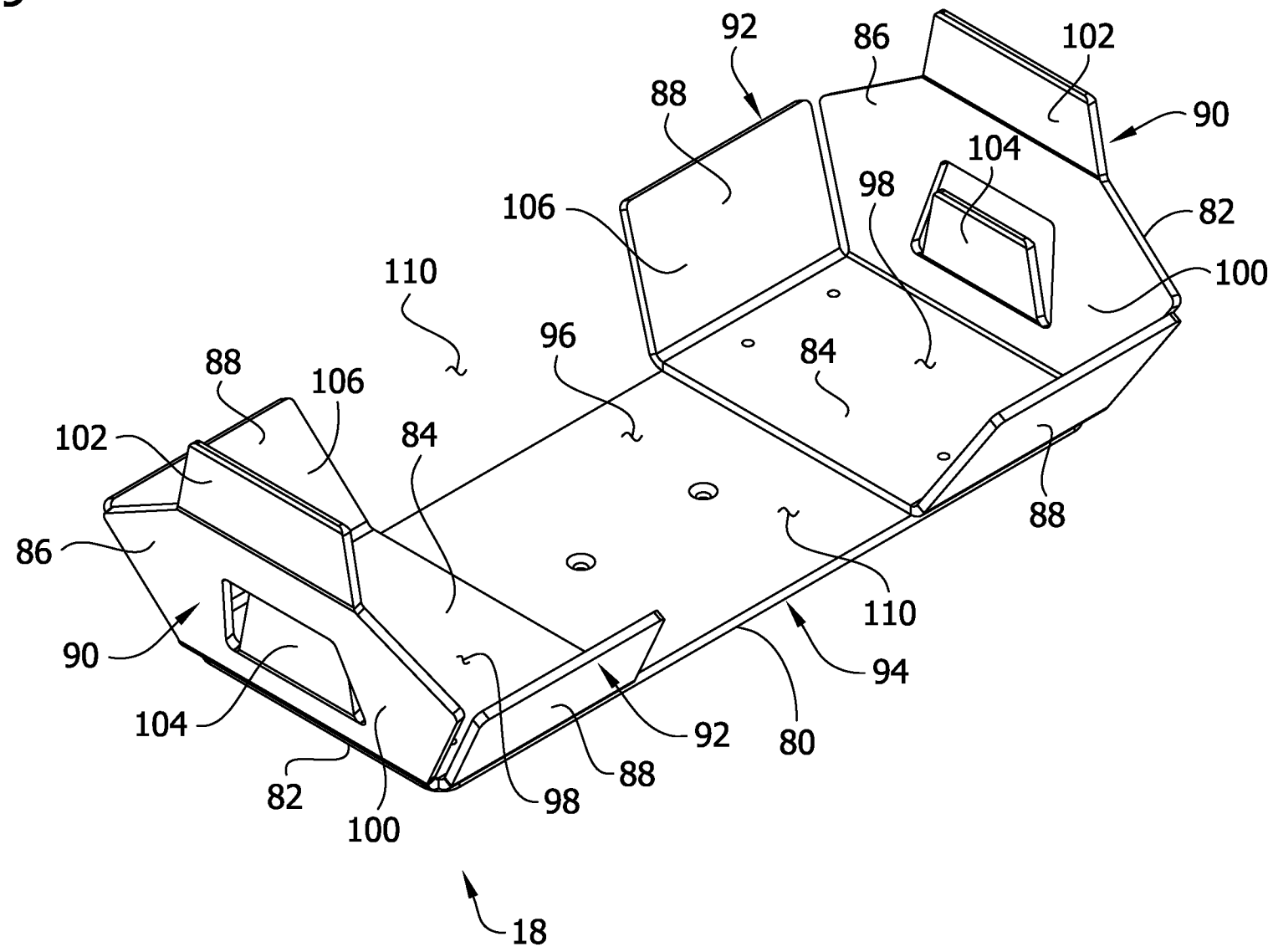
FIG. 9 is a perspective of a cradle of the free weight system.
Figure 10:
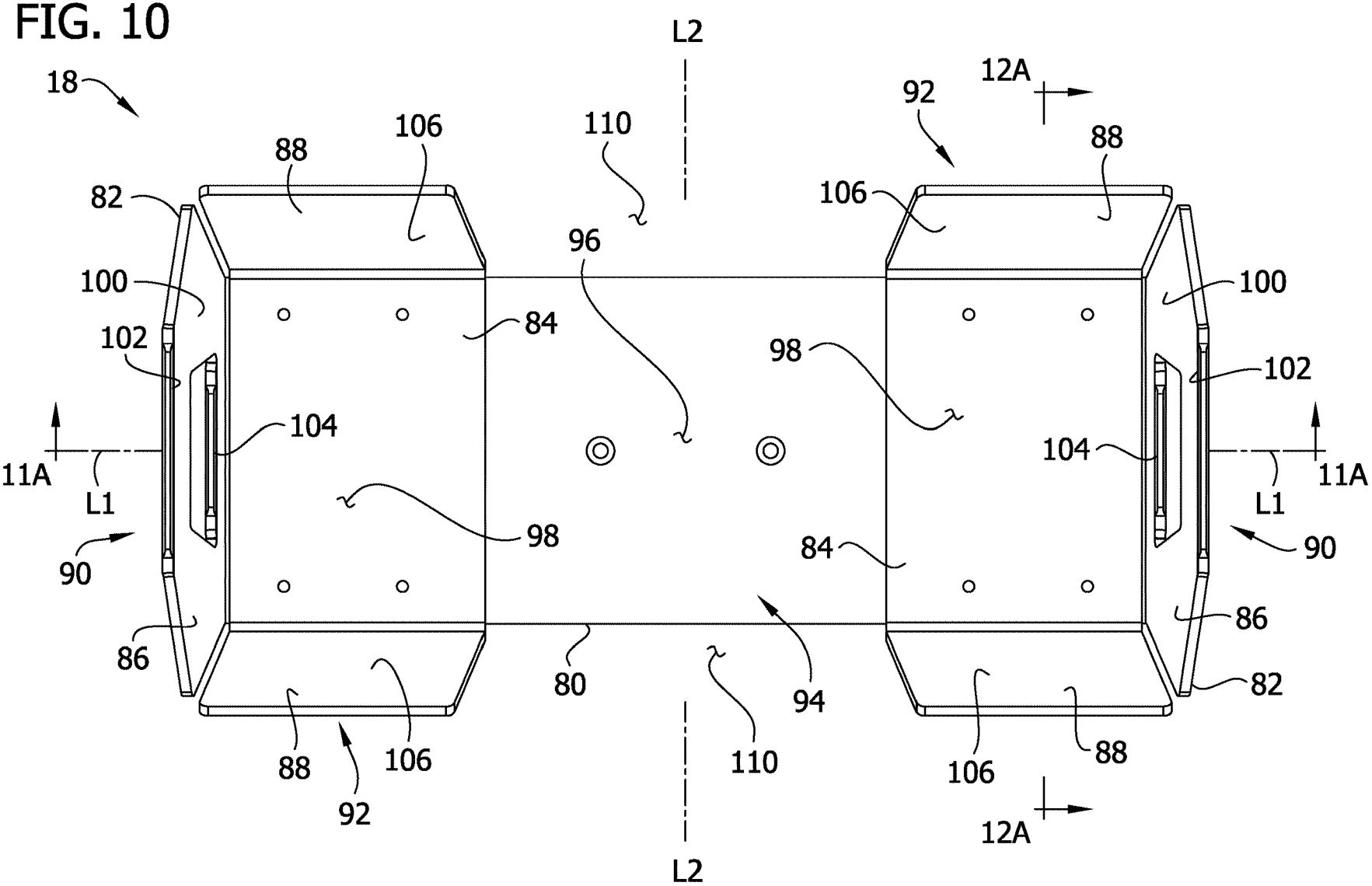
FIG. 10 is a top plan view of the cradle.

Referring to FIGS. 7-8B, each of the weight plates 44 also includes a selector shaft hole 62 (broadly, central openings) positioned at a center of the plate for allowing the passage of selector shafts 70 (see, FIG. 8B) in and out of the weight plates for engaging and selecting the desired amount of weight. The skewed orientation of the main body portions 49 of the plates 44 with respect to a longitudinal axis of the handle 34, in combination with the locking mechanisms 50, cause a portion of the weight plates 44 to be held at a skewed angle with respect to the longitudinal axis of the handle when the weight plates are retained on the handle assembly 32 by the selector shafts 70.

Selection of the desired weight is achieved through manipulation of the knobs 46 which in turn actuate components of the handle assembly 32. Referring to FIGS. 8A-8B, the handle assembly comprises the handle 34, selector shafts 70, and a gear assembly 72. The knobs 46 and gear assembly 72 are broadly an adjustment assembly. The adjustment assembly is operatively connected to the selector shafts 70 so that when the knob 46 is turned, it drives the gear assembly 72 to move the selector shafts inward and outward along the longitudinal axis of the handle 34. From an innermost position (FIG. 8A), the selector shafts 70 are driven outwardly through the selector shaft holes 62 of the weight plates 44 in each weight plate set 36 sequentially, from the innermost weight plate to the outermost weight plate. When the selector shaft 70 extends through a selector shaft hole 62 in a weight plate 44, it retains the weight plate to the dumbbell assembly 14. For example, as shown in FIG. 8B, the four weight plates 44 nearest each of the collars 38, 40 are retained to the dumbbell assembly 14. When the dumbbell illustrated in FIG. 8B is lifted, the selector shaft 70 engages the selector shaft holes 62 of the inner four weight plates 44 in each weight plate set 36 and applies an upwardly oriented force thereupon. The upwardly oriented force causes the locking tangs 54, 55 of each weight plate 44 to engage the respective locking slots 56, 57 of an inwardly adjacent weight plate. The outwardly facing shoulders 58, 59 lockingly engage the corresponding inwardly facing shoulders 60, 61 to prevent the outer retained weight plate 44 from moving relative the dumbbell assembly along the longitudinal axis of the handle 34.

It is important that the weight plates 44 are precisely and repeatably aligned when in the cradle 18 to facilitate weight selection. The knobs 46 and gear assembly 72 provide only a small amount of leverage on the selector shafts 70 to drive them along the longitudinal axis of the handle 34 through the central selector shaft holes 62. Moreover, the selector shafts 70 are shaped and sized to fit in the selector shaft holes 62 in relatively close tolerance to prevent travel of the weight plates 44 relative the handle assembly 32 as the dumbbell assembly 14 is moved around during use. If the selector shaft holes 62 in either of the weight plate sets 36 are eccentric to one another, the respective selector shaft 70 cannot extend through the holes upon actuation of the knob 46. The misaligned plates 44 will block passage of the selector shaft 70 through the selector shaft holes 62. Thus the operability of the adjustment assembly is enhanced with repeatable, concentric alignment of the selector shaft holes 62. As discussed in further detail below, the cradles 18 are configured to receive the dumbbell assemblies 14 therein in a cradled position in which the walls of the cradles engage the weight plate sets 36 to align the weight plates 44 both vertically and horizontally so that the central openings are always substantially concentric, thus enabling uninhibited operation of the adjustment assemblies to select weights.

Referring to FIGS. 9-12, each cradle 18 includes a lower mounting plate 80 and first and second cradle brackets 82. The mounting plate 80 is a substantially planar, rectangular sheet of material (e.g., steel) with mounting holes extending through the thickness of the material to receive fasteners for securing the cradle 18 to the stand 12. The mounting plate 80 is configured to be attached to the leg 22 of the stand 12 (e.g., using screws, etc.) to secure the cradle 18 to the stand (FIGS. 1 and 2). In addition, the cradle brackets 82 are configured for attachment to the mounting plate 80 (e.g., using screws, welds, etc.) adjacent the longitudinal ends thereof to form the cradle 18. In the illustrated embodiment, each bracket 82 is one piece of material. Each bracket 82 includes a bottom panel 84 (broadly, a bottom member), an end panel 86 (broadly, a longitudinal end member), and opposite side panels 88 (broadly, lateral side members). The bottom panel 84 includes mounting holes arranged for concentric alignment with mounting holes adjacent a respective end of the lower mounting plate 80 for receiving fasteners used to secure the bracket to the mounting plate. In certain embodiments, the mounting holes in either of the brackets 82 or the mounting plate 80 are elongate slots to allow for longitudinal adjustment of the size of the cradle 18.

When both brackets 82 are mounted on the mounting plate 80, the end panels 86 form first and second end walls 90 of the cradle 18 that are spaced apart from one another along a longitudinal axis L1 of the cradle. The opposite side panels 88 of the two bracket members 82 form first and second side walls 92 of the cradle 18 spaced apart from one another along a lateral axis L2 and extending generally parallel to the longitudinal axis L1. The bottom panels 84 of the two cradle brackets 82 and mounting plate 80 form a bottom wall 94 of the cradle 18 which extends generally parallel to the longitudinal and lateral axes L1, L2. Though in the illustrated embodiment the side walls 92 are respectively formed by panels 88 of two separate cradle brackets 82 that are spaced apart along the longitudinal axis L1 of the cradle 18, it will be understood that the side walls can be substantially continuous without departing from the scope of the invention. Likewise, the cradles can be formed from one piece without departing from the scope of the invention.

The first and second end walls 90, first and second side walls 92, and bottom wall 94 of the cradle 18 define a cavity 96. As shown in FIGS. 13-18, the cavity 96 is sized to receive the dumbbell assembly 14 in the cradled position such that a first one of the weight plate sets 36 is located adjacent the first end wall and a second one of the weight plate sets is located adjacent the second end wall. Referring again to FIGS. 9-12, the bottom panel 84, end panel 86, and side panels 88 of each cradle bracket 82 define a weight plate set-receiving cavity 98 sized to receive a respective one of the weight plate sets 36 therein when the dumbbell assembly 14 is in the cradled position. As shown in FIGS. 13-18 and as will be discussed in greater detail below, the first and second end walls 90 are sized and arranged to engage an outermost one of the weight plates 44 in the respective set 36 to inhibit the dumbbell assembly 14 from moving along the longitudinal axis L1 from the cradled position. Likewise, the first and second side walls 92 are sized and arranged to engage a portion of the outer perimeter surface of the weight plates 44 in each of the weight plate sets 36 to inhibit the weight plate sets from moving parallel to the lateral axis L2 or along the vertical axis V toward the bottom wall 94 from the cradled position.

Figure 11:
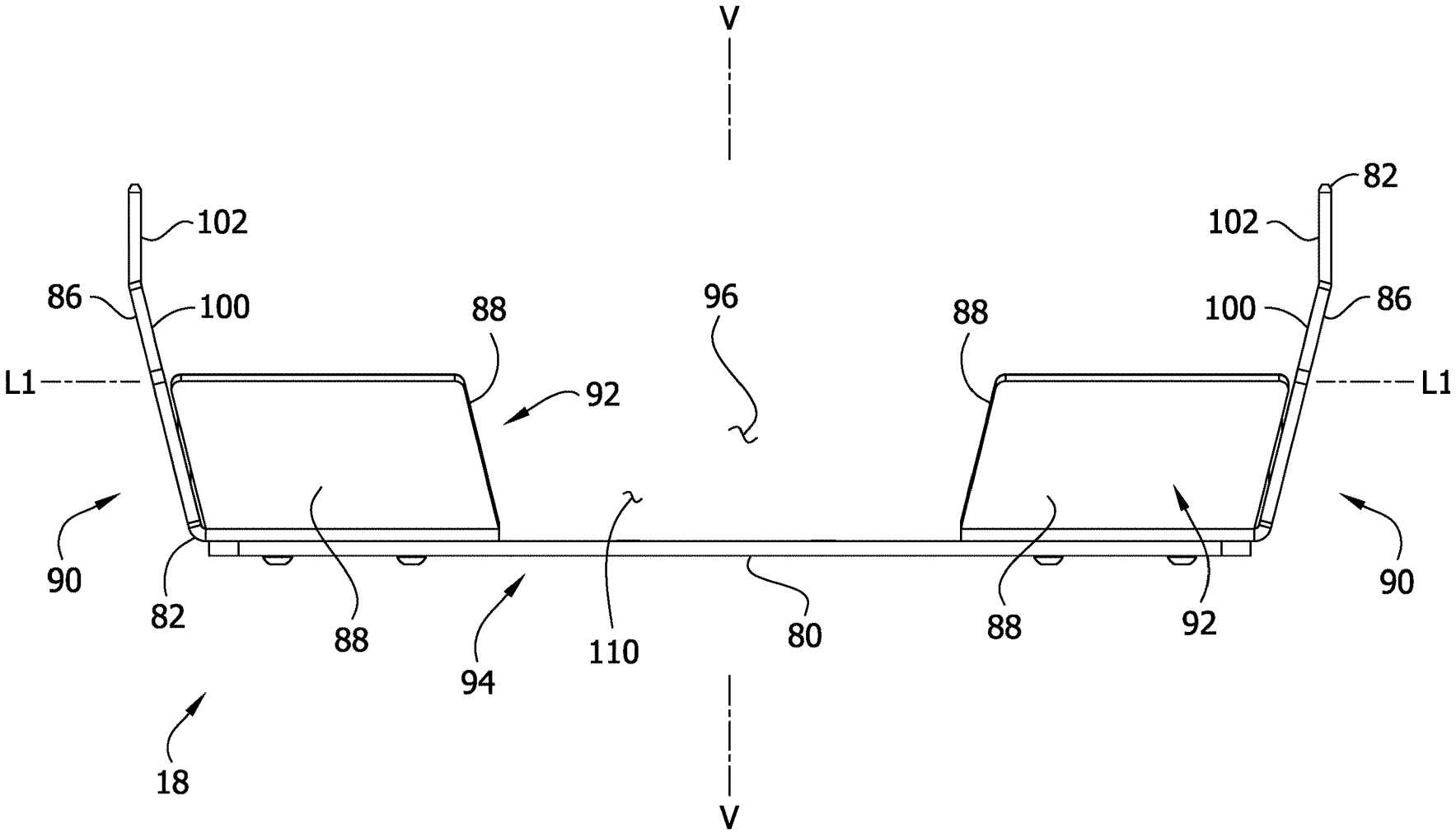
FIG. 11 is a side elevation of the cradle.
Figure 11A:
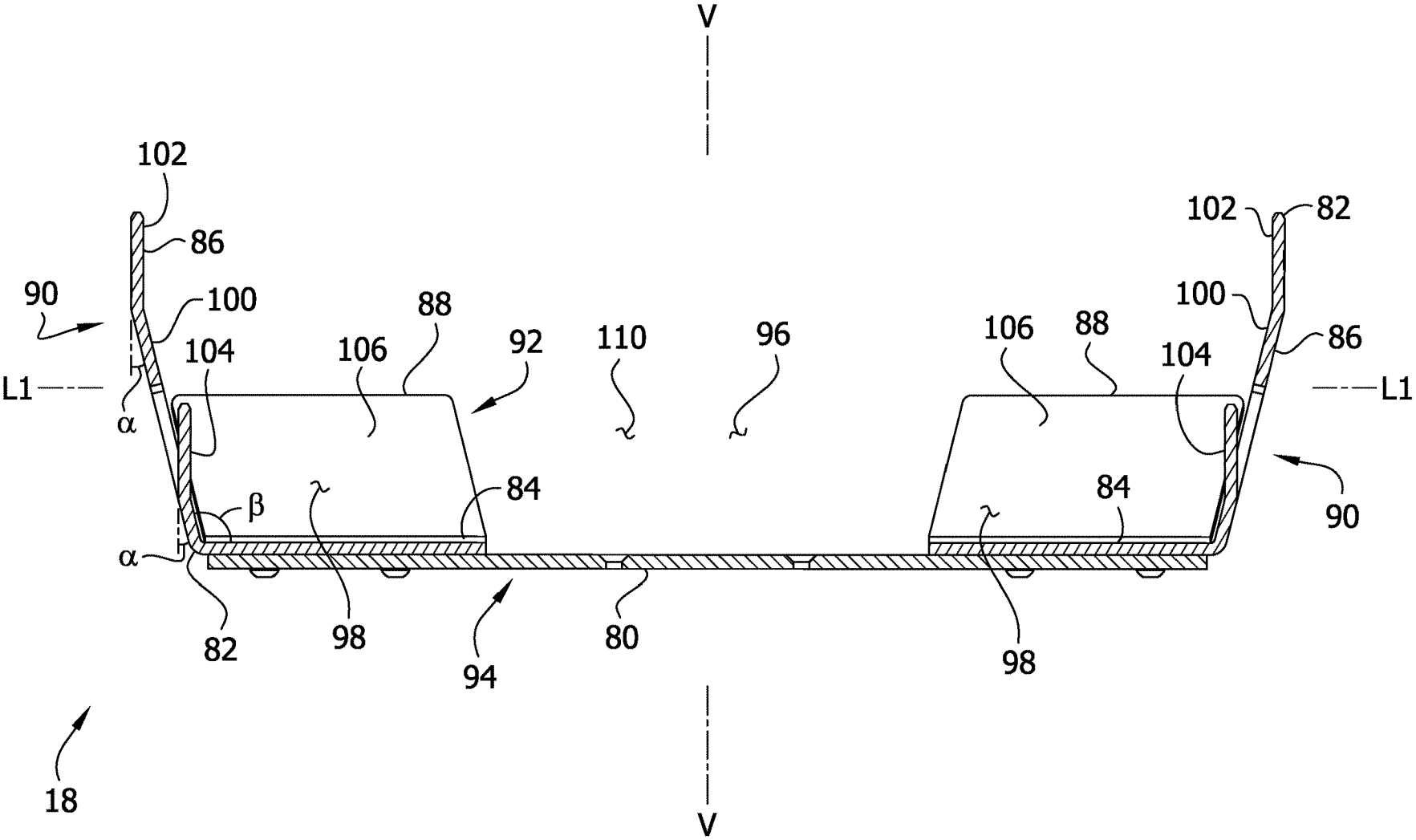
FIG. 11A is a section view taken in the plane of line 11A-11A of FIG. 10.

As shown in FIGS. 9-12, the end panel 86 of each cradle bracket 82 is bent upward from the bottom panel 84. A main body portion-engaging facet 100 (broadly, a plate-engaging portion of the end wall 90) of the end panel 86 is positioned directly adjacent the bottom panel 84. The main body portion-engaging facet 100 is shaped and arranged to engage the main body portion 49 of an outermost weight plate 44 when the dumbbell assembly 14 is received in the cavity 96 in the cradled position. As shown in FIG. 11A, the main body portion-engaging facet 100 is oriented at an angle $\beta$ of about 104° with respect to the bottom panel 84 and forms an angle $\alpha$ of about 14° with respect to the vertical axis V (e.g., an axis substantially perpendicular to the underlying support surface S).

A central locking tang-engaging facet 102 and a lower locking tang-engaging facet 104 (each, broadly, a locking element-engaging portion of the end wall 90) extend inward from the main body portion-engaging facet 100. More specifically, the central locking tang-engaging facet 102 is bent inward from the top of the main body portion-engaging facet 100. The lower locking tang-engaging facet 104 is formed by making cut in the panel 86. The area inside the cut is bent inward from the main body portion-engaging facet 100 to match the shape of the lower locking tangs 55 of the weight plates 44. Each of the locking tang-engaging facets 102, 104 is oriented generally parallel to the vertical axis V and skewed from the main body portion-engaging facet 100 at an angle $\alpha$ of about 14° to match the skew angle $\alpha$ of the locking tangs 54, 55 with respect to the main body portion 49 of the weight plates 44. The locking tang-engaging facets 102, 104 are shaped and arranged to engage the locking tangs 54, 55 of an outermost weight plate 44 when the dumbbell assembly 14 is received in the cavity 96. It will be understood that the end panels 86 could be formed without either or both of the locking tang-engaging facets 102, 104 without departing from the scope of the invention.

Figure 17:
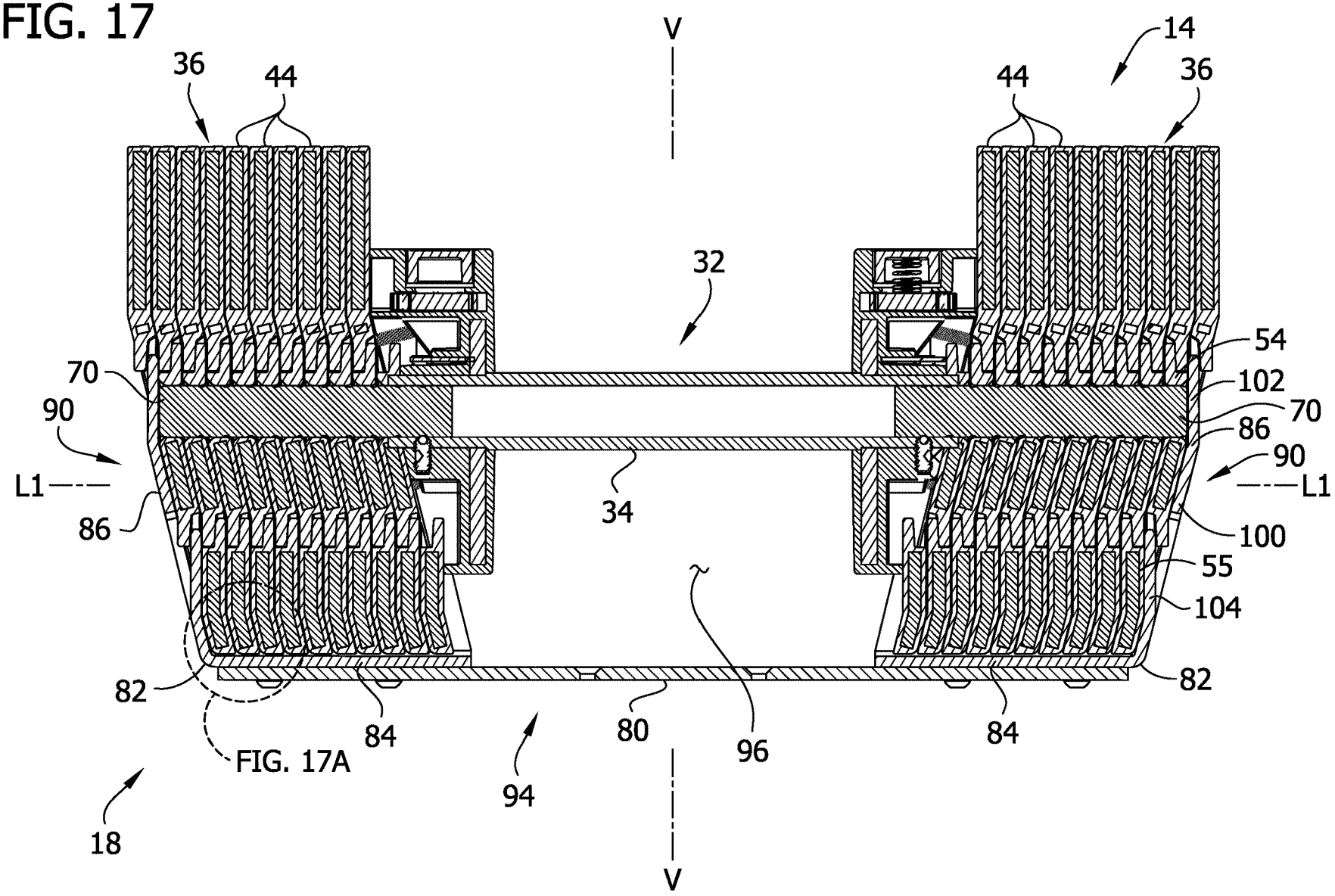
FIG. 17 is a section taken in the plane of line 17-17 of FIG. 14.

As shown in FIG. 17, when the dumbbell assembly 14 is received in the cavity 96 in the cradled position, the end panels 86 engage the outermost plates 44 in each of the weight plate sets 36 to center the dumbbell assembly between the end walls 90 of the cradle 18. The locking tang-engaging facets 102, 104 engage the locking tangs 54, 55 of the respective outermost plates 44 in parallel vertical planes, and the main body portion-engaging facets 100 engages the main body portions 49 in respective planes that slope longitudinally outward and upward. The engagement between the end panels 86 and the outermost plates 44 of each of the weight plate sets 36 substantially inhibits the dumbbell assembly 14 from moving along the longitudinal axis L1 from the cradled position. When the dumbbell assembly 14 is lifted from the cradle 18 in use with less than all of the plates 44 in the weight plate sets 36 retained on the handle assembly 32, the engagement between the end panels 86 and the outermost plates supports the unretained plates in the illustrated upright position and inhibits the unretained plates from shifting.

Figure 12:
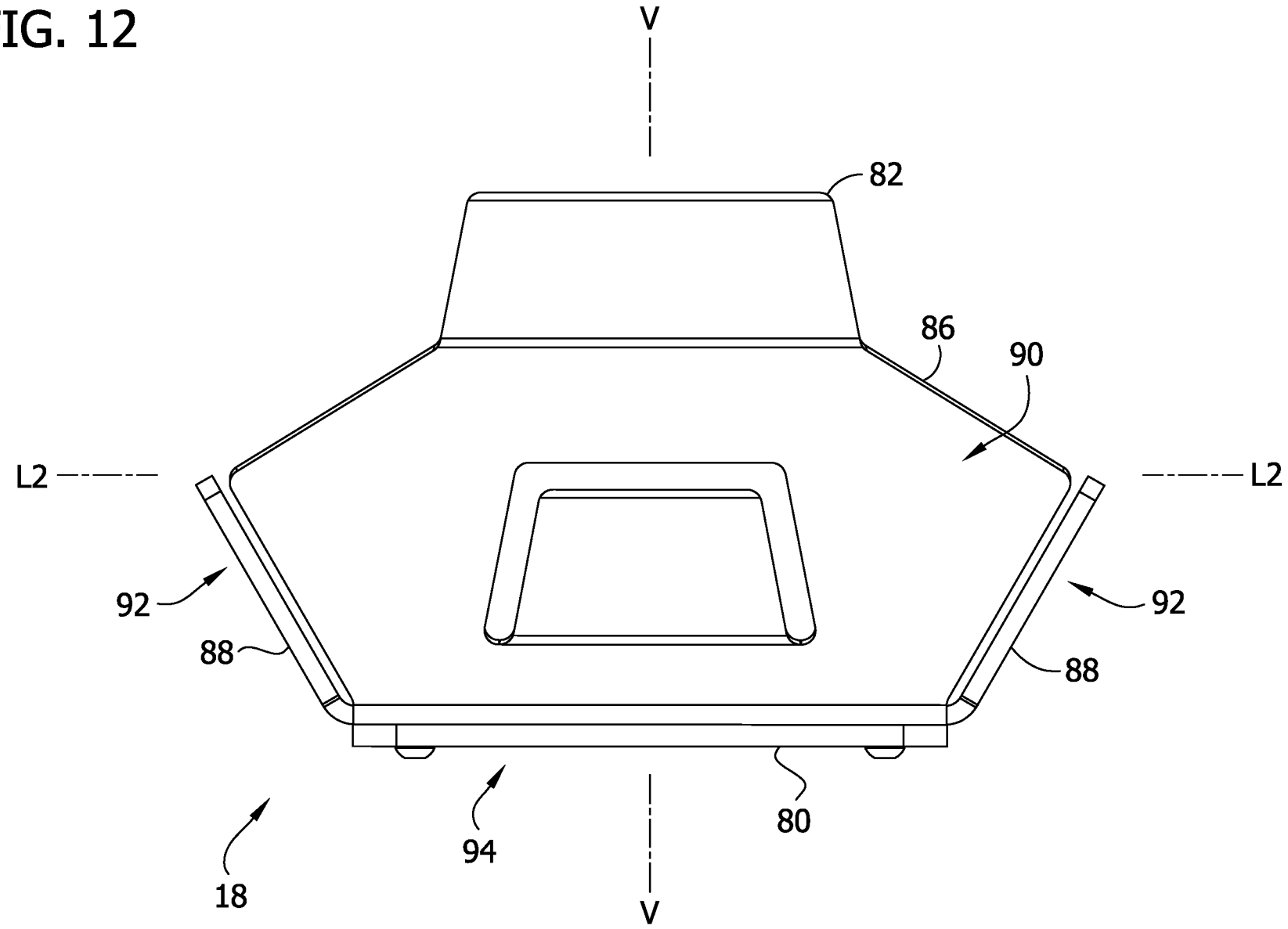
FIG. 12 is an end elevation of the cradle.
Figure 12A:
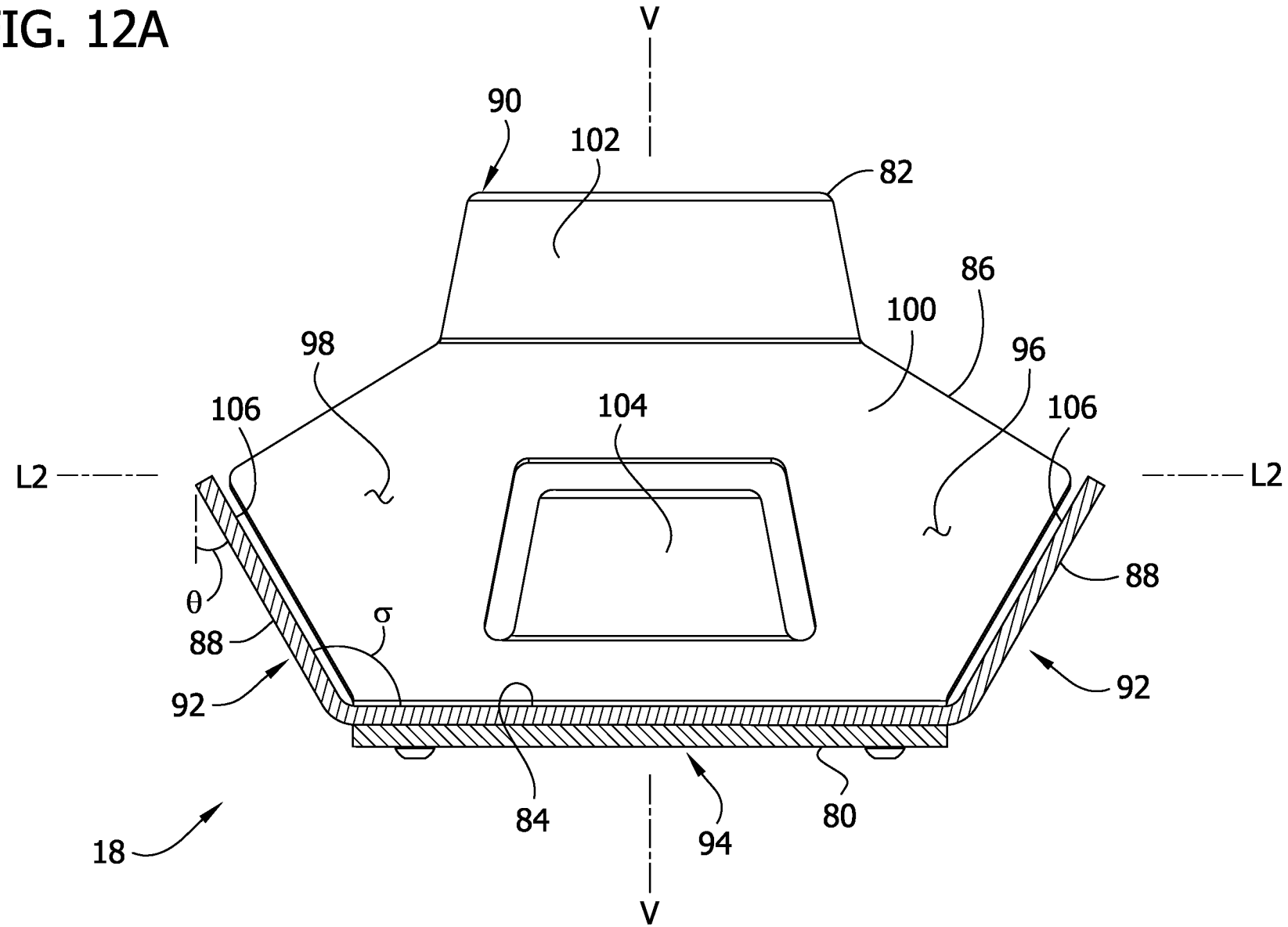
FIG. 12A is a section view taken in the plane of line 12A-12A of FIG. 10.

Referring to FIG. 12A, for each cradle bracket 82, each of the side panels 88 is bent upward from the bottom panel 84. The side panels 88 each have top and bottom edges and an inboard surface 106 extending between the top and bottom edges. Each inboard surface 106 slopes laterally inwardly as it extends from adjacent the top edge toward the bottom edge of the respective side panel 88. In the illustrated embodiment, the inboard surfaces 106 are substantially planar, but they can also be contoured (e.g., curved) without departing from the scope of the invention. The inboard surface 106 of each side panel 88 is suitably oriented at an angle Φ with respect to the bottom panel 84 and the same angle θ with respect to the vertical axis V. In one or more embodiments, the inboard surfaces 106 are oriented at an angle Φ with respect to the bottom panel 84 of from about 115° to about 155°. In the illustrated embodiment the angle Φ is about 120°. In one or more embodiments, the inboard surfaces 106 are oriented at an angle θ with respect to the vertical axis V of from about 25° to about 65°. In the illustrated embodiment the angle θ is about 30°.

Figure 17A:
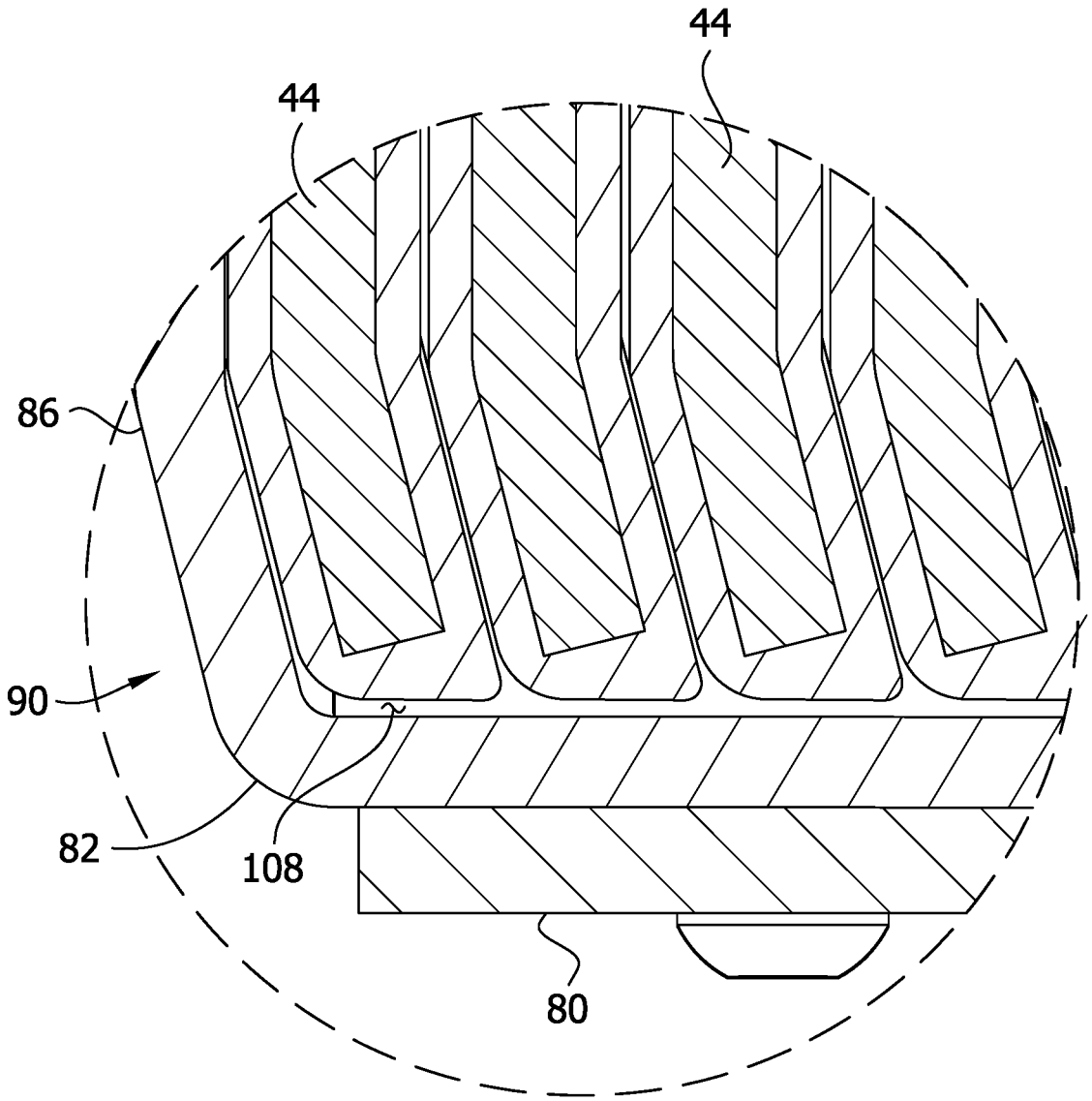
FIG. 17A is an enlarged view of a portion of FIG. 17.
Figure 18:
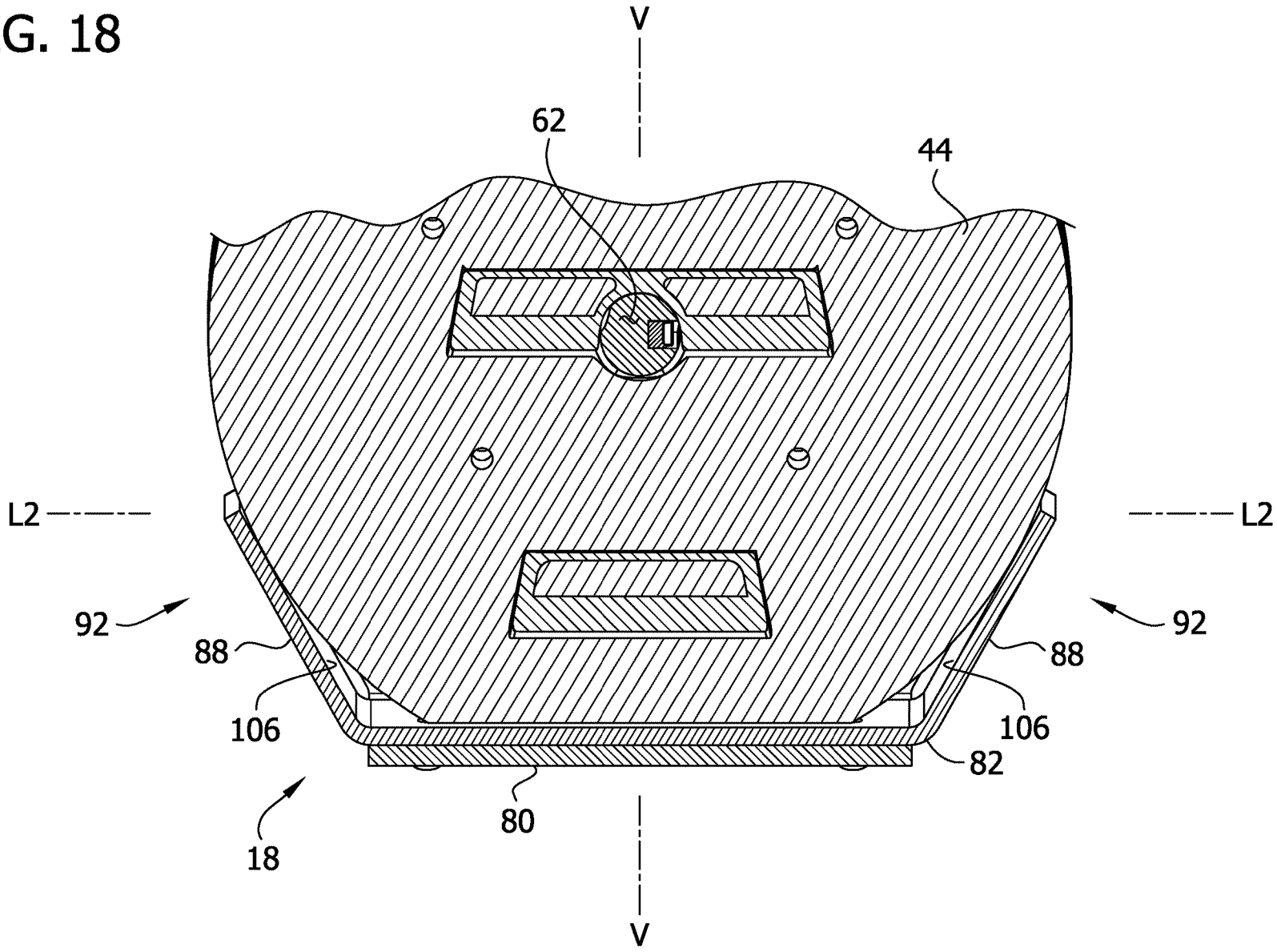
FIG. 18 is a fragmentary section generally taken in the plane of line 18-18 of FIG. 15.

Referring to FIG. 18, the angled inboard surfaces 106 of each cradle bracket 82 form a truncated V-shape support structure configured to receive and support one of the weight plate sets 36 therein and to automatically center the weight plates 44 of the weight plate set between the side walls 92 of the cradle 18 under the weight of the dumbbell assembly 14. The inboard surfaces 106 of each of the cradle brackets 82 is adapted to engage perimeter portions of each of the weight plates 44 in the respective weight plate set 36 to substantially inhibit the weight plate set from moving along the lateral axis L2 of the cradle 18. In addition, the inboard surfaces 106 of the cradle bracket 82 supports the weight of the respective plate set 36 to substantially inhibit the weight plate set from moving along the vertical axis V toward the bottom edges of the side panels 88. The weight of the weight plates 44 drives the weight sets 36 downward against the substantially rigid support of the cradle 18. Each time the dumbbell assembly 14 is placed into the cradle 18, the weight of the weight sets 36 pull the weight plates 44 downward into the cradle brackets 82. The engagement of the weight plates 44 with the side panels 88 under the force of their weight causes the plates to be driven vertically and horizontally to repeatably align each of the weight plates in the same position with respect to the lateral and vertical axes L2, V. Referring to FIG. 17A, the side panels 88 support the respective weight plate set 36 so that the bottom ends of the weight plates 44 are spaced apart from the bottom panel 84 (broadly, a surface underlying the weight plate set) of the cradle bracket 82. Thus a gap 108 is formed between the bottom ends of the weight plates 44 and the bottom panel 84 when the dumbbell assembly 14 is received in the cavity 96 in the cradled position.

As shown in FIGS. 17-18, the configuration of the inboard surfaces 106 of the side panels 88 of each of the cradle brackets 82 employs the weight of the weight plates 44 to repeatably align the weight plates 44 in the respective weight plate set 36 both vertically and horizontally so that the selector shaft holes 62 in the weight plates are substantially concentric. Because the inboard surfaces 106 of the side panels 88 of each of the cradle brackets 82 slope inwardly and each weight plate 44 has an inwardly tapered lower perimeter shape, engagement between the inboard surfaces and the perimeters of the weight plates automatically centers the weight plates between the side walls 92 of the cradle 18. Moreover, since each of the weight plates 44 has the same perimeter shape, the inboard surfaces 106 contact the same portions of the perimeter of each of the weight pates, thereby arranging all the weight plates in the same position along the lateral axis L2. The inboard surfaces 106 of the side panels 88 also substantially support the weight of each of the plates 44 to align the plates in the same position along the vertical axis V. As a result, the selector shaft holes 62, which are each positioned in the same location with respect to the perimeter of the respective weight plate 44, are aligned concentrically with one another by virtue of the engagement between the inboard surface 106 of the side panels 88 and the perimeters of the respective weight plates.

Figure 13:
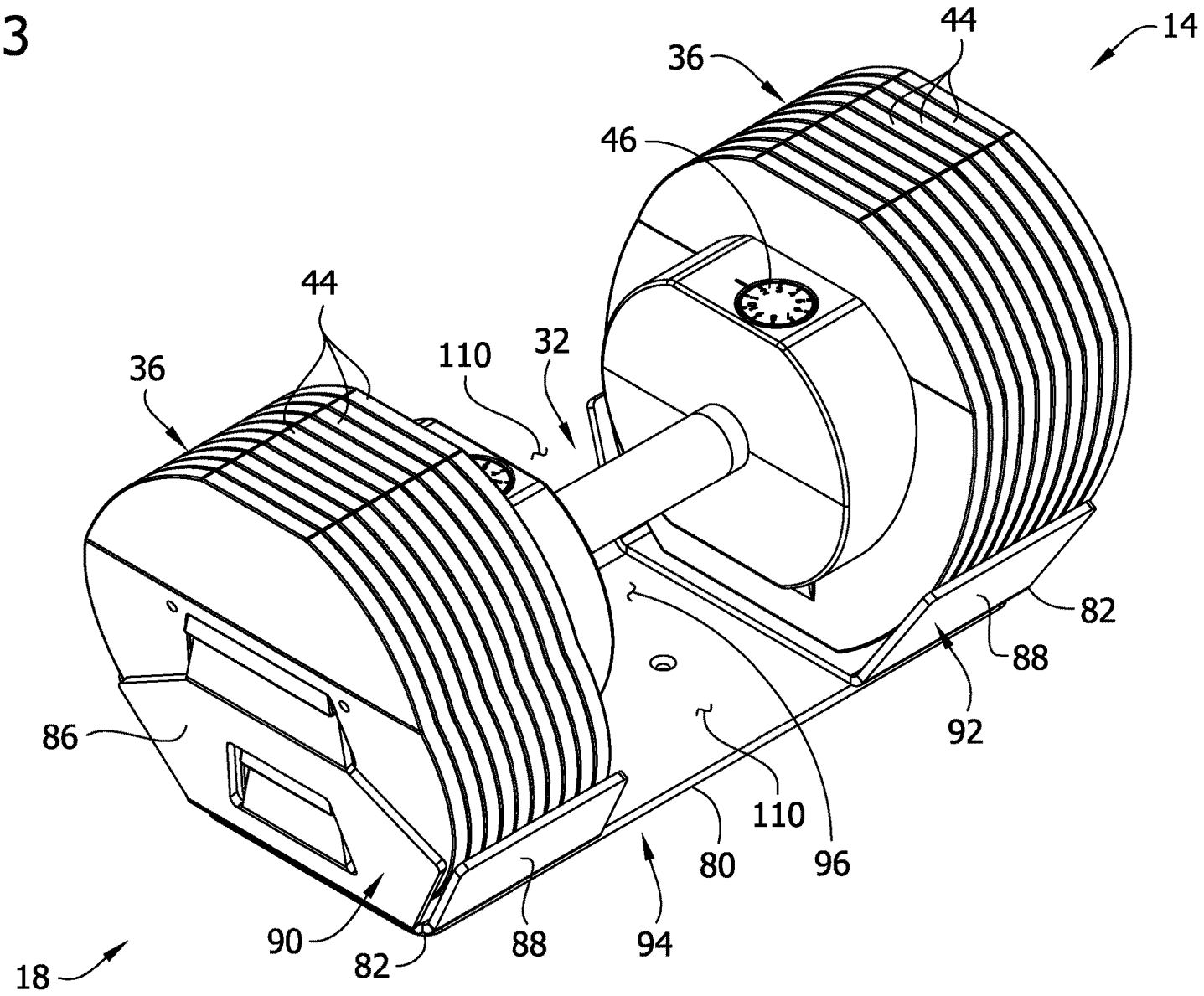
FIG. 13 is a perspective of the cradle and dumbbell assembly, illustrating the dumbbell assembly in a cradled position.
Figure 14:
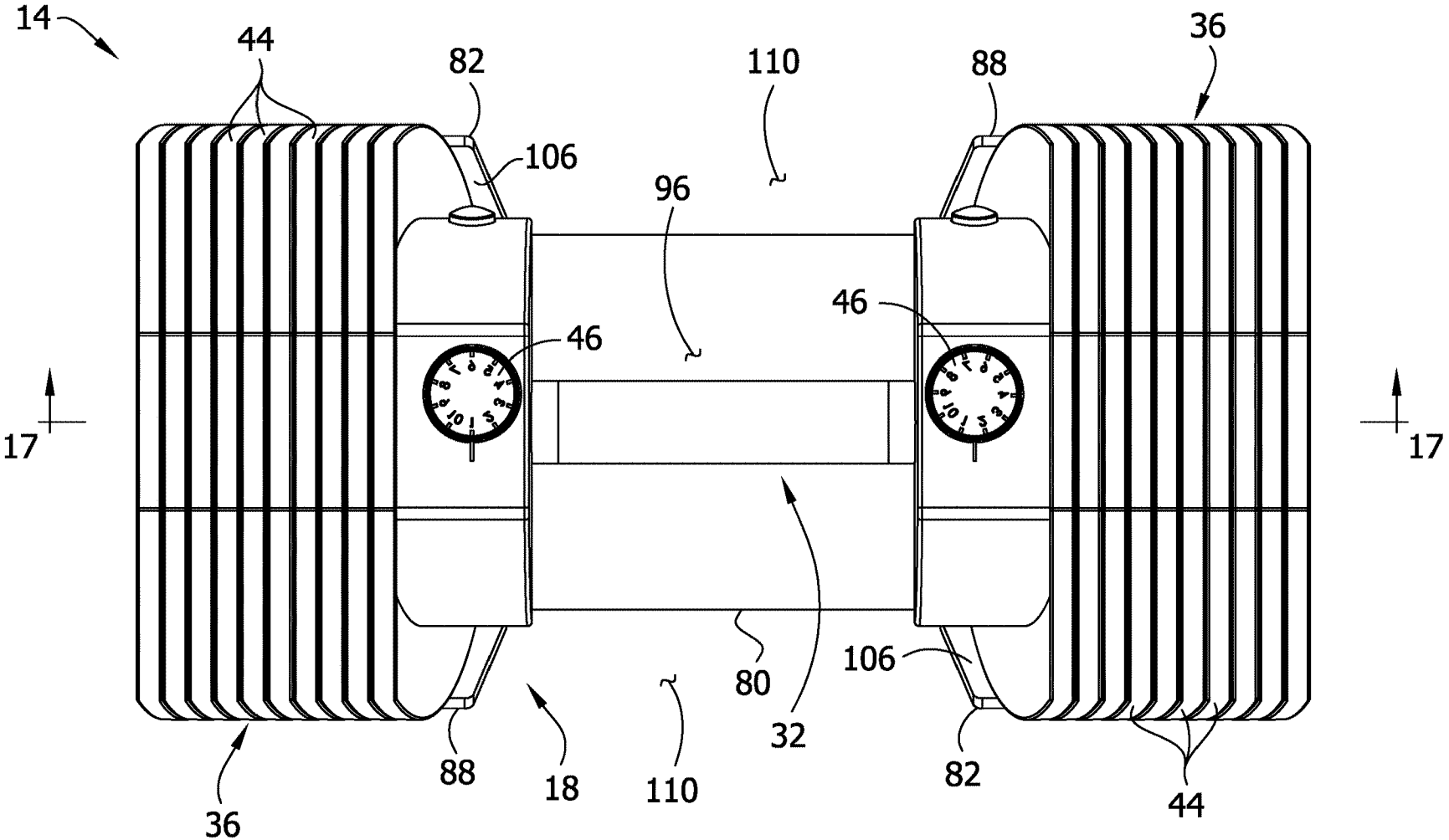
FIG. 14 is top plan view of the cradle and dumbbell assembly.
Figure 15:
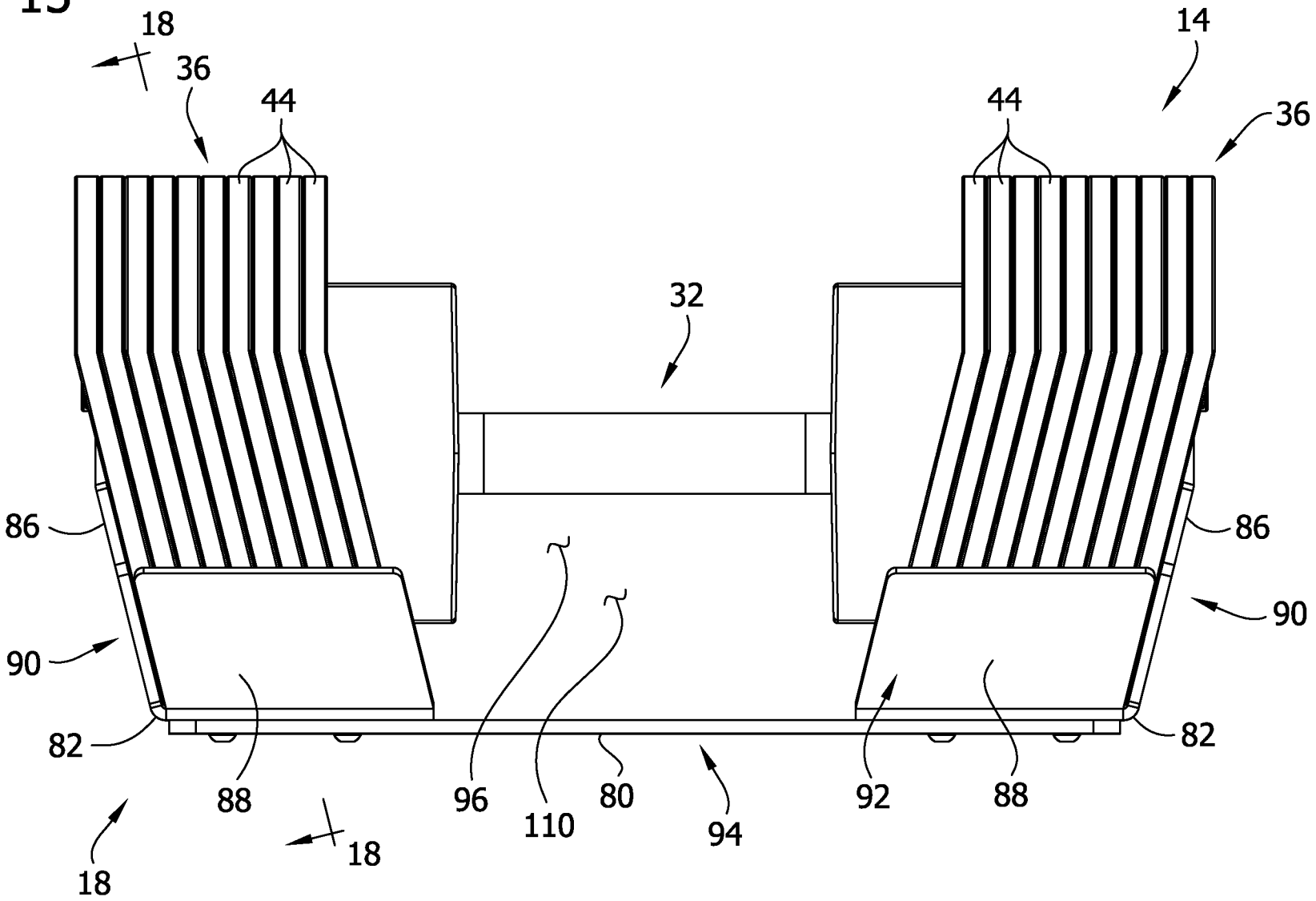
FIG. 15 is a side elevation of the cradle and dumbbell assembly.
Figure 16:
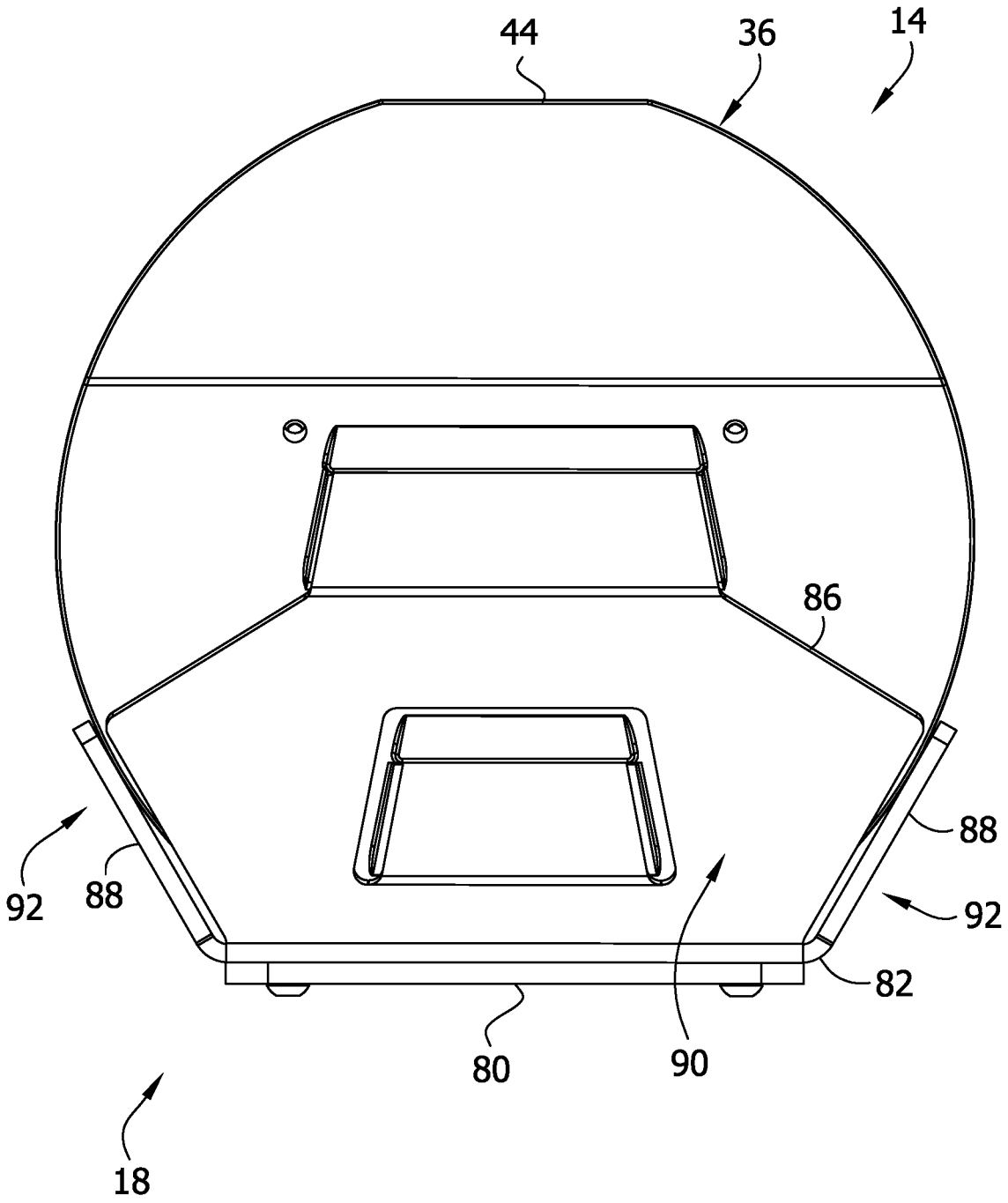
FIG. 16 is an end elevation of the cradle and dumbbell assembly.

Referring to FIGS. 9-12, in the illustrated embodiment, the side panels 88 form longitudinally spaced apart portions of the opposite side walls 92. The inboard surfaces 106 of one of the cradle brackets 82 are adapted to engage and align the weight plates 44 of one of the weight plate sets 36 and the inboard surfaces of the other cradle bracket are adapted to engage and align the weight plates of the other weight plate set. The two side panels 88 form end portions of each of the side walls 92 and are spaced apart from one another along the longitudinal axis L1 to provide a laterally extending gap 110 in the side walls. As shown in FIGS. 13-15, the gaps 110 are longitudinally aligned with the tubular handle 34 of the dumbbell assembly 14 when the dumbbell assembly is received in the cavity 96. The gaps 110 provide space for a user to reach into the cavity 96 to grasp the tubular handle 34 or manipulate the knobs 46 of the dumbbell assembly 14. In an alternative embodiment, the cradle can be formed with one piece side walls 92 that extend continuously between the end walls 90.

Referring to FIGS. 1 and 2, in use a user adjusts the knobs 46 to select the desired number of weight plates 44 to retain to the dumbbell assemblies 14. With the desired number of weight plates 44 selected, the user lifts the dumbbell assemblies 14 from the cradles 18. Any unselected weight plates 44 lean outwardly against the end panels 86 of the respective cradle brackets 82 without tipping over. The dumbbell assemblies 14 can be returned to the cradled position by being inserted into the cavities 96. Because the lower end portions of the weight plates 44 slope longitudinally inward, there is ample space in the cavities 96 for receiving the dumbbell assemblies 14 and selected weight plates 44. Moreover, the sloped main body portions 49 of the weight plates 44 engage one another as the dumbbell assemblies 14 are being inserted into the cradles 18 to center the dumbbell assemblies between the end walls 90 of the cradle. Likewise, the inwardly sloped side walls 92 of the cradles 18 provide a wide lateral opening for receiving the weight sets 36 and center the dumbbell assemblies 14 horizontally as the dumbbell assemblies are inserted into the cradles. With the dumbbell assemblies 14 in the cradled positions in the respective cradles 18, the inboard surfaces 106 of the side panels 88 engage portions of the outer perimeters of the weight plates 44 to concentrically align the selector shaft holes 62 for receiving the selector shafts 70.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A free weight system comprising:

an adjustable free weight assembly comprising first and second weight plate sets and a selector shaft, the first and second weight plate sets comprising a plurality of weight plates, each weight plate comprising a plate portion and a locking element for selectively securing the weight plate to an adjacent weight plate, each weight plate further comprising a central opening for receiving the selector shaft for retaining the weight plate to the free weight assembly; and a cradle for supporting the adjustable free weight assembly in a cradled position, the cradle having first and second longitudinally opposite ends, a first pair of side walls located at the first end of the cradle and a second pair of side walls located at the second end of the cradle, the first and second pairs of side walls at least partially defining a cavity sized to receive the free weight assembly therein in the cradled position, each pair of side walls being spaced apart from one another along a lateral axis of the cradle and extending generally parallel to the longitudinal axis of the cradle at a respective one of the first and second ends of the cradle, each of the side walls having top and bottom edges and an inboard surface extending between the top and bottom edges, the inboard surface sloping laterally inwardly as it extends from adjacent the top edge toward the bottom edge, the inboard surfaces of each pair of the side walls being adapted to engage portions of a respective one of the first weight plate set and the second weight plate set to substantially inhibit said one of the first weight plate set and second weight set from moving parallel to the lateral axis and toward the bottom edges of the side walls, the configuration of the inboard surfaces of each pair of side walls aligning a respective one of the first and second weight plates both vertically and horizontally so that the central openings are substantially concentric;

the first weight plate set and second weight plate set being sized and shaped so that when the free weight assembly is received in the cradle and supported in the cradled position, the first weight plate set and the second weight plate set are each supported and held by a respective pair of the side walls above the bottom edges of the side walls;

wherein the entirety of each weight plate of the first weight plate set and of the second weight plate set is spaced apart from a surface of the cradle underlying and facing the first weight plate set and second weight plate set, respectively, when the first weight plate set and second weight plate set are supported and held by respective pairs of the side walls of the cradle in the cradled position, the surface extending between the bottom edges of each pair of side walls.

2. The free weight system as set forth in claim 1 further comprising first and second end walls spaced apart from one another along a longitudinal axis of the cradle and partially defining the cavity sized to receive the free weight assembly therein in the cradled position such that the first weight plate set is located adjacent the first end wall and the second weight plate set is located adjacent the second end wall, an engagement between the first and second end walls and outermost plates of the first and second weight plate sets substantially inhibiting the adjustable free weight assembly from moving along the longitudinal axis from the cradled position.

3. The free weight system as set forth in claim 1 wherein the first and second pairs of side walls are spaced apart from one another along the longitudinal axis to provide a laterally extending gap between the first and second pairs of side walls that is arranged for longitudinal alignment with a handle assembly of the free weight assembly.

4. The free weight system as set forth in claim 1 wherein the inboard surfaces of each pair of side walls are oriented at an angle of between about 25° and about 65° with respect to a vertical axis oriented perpendicular to the longitudinal and lateral axes.

5. The free weight system as set forth in claim 1 further comprising a one-piece component that includes the first and second pairs of side walls, the first and second end walls, and a base member including the surface.

6. The free weight system as set forth in claim 5 wherein the first and second end walls and the first and second pairs of side walls are bent upward from the bottom member.

7. The free weight system as set forth in claim 2 wherein each of the first and second end walls comprise a plate-engaging portion and a locking element-engaging portion extending longitudinally inward from the plate engaging portion, the plate-engaging portion of each end wall being shaped and arranged to engage the plate portion of an outermost one of the weight plates in the respective weight plate set and the locking element-engaging portion being shaped and arranged to engage the locking element of the respective outermost one of the weight plates when the free weight assembly is in the cradled position.

8. A cradle for supporting an adjustable free weight assembly in a cradled position, the free weight assembly comprising first and second weight plate sets comprising a plurality of weight plates, each weight plate comprising a plate portion and a locking element for selectively securing the weight plate to an adjacent weight plate, each weight plate further comprising a central opening for receiving a selector shaft of the free weight assembly for retaining the weight plate to the free weight assembly, said cradle comprising;

first and second end walls spaced apart from one another along a longitudinal axis of the cradle and partially defining a cavity sized to receive the free weight assembly therein in the cradled position such that the first weight plate set is located adjacent the first end wall and the second weight plate set is located adjacent the second end wall, an engagement between the first and second end walls and outermost plates of the first and second weight plate sets substantially inhibiting the adjustable free weight assembly from moving along the longitudinal axis from the cradled position;

first and second side walls spaced apart from one another along a lateral axis of the cradle and extending generally parallel to the longitudinal axis of the cradle to further define the weight assembly cavity, the first and second side walls each having top and bottom edges and an inboard surface extending between the top and bottom edges, the inboard surface sloping laterally inwardly as it extends from adjacent the top edge toward the bottom edge, the inboard surfaces of the first and second side walls being adapted to engage portions of at least the first weight plate set to substantially inhibit the first weight plate set from moving parallel to the lateral axis and toward the bottom edges of the first and second side walls, the configuration of the inboard surfaces of the first and second side walls being arranged with respect to each other in relation to dimensions of the weight plates received by the cradle for aligning the weight plates both vertically and horizontally so that the central openings are substantially concentric; and a surface underlying the first weight plate set and wherein the first and second side walls support and hold the first weight plate set in a spaced apart relationship with the surface underlying the first weight plate set to form a gap between the surface and a lower end of the first weight plate set;

wherein the surface underlying the first weight plate set extends between the bottom edges of the first and second side walls, wherein the entirety of each weight plate of the first weight plate set is spaced apart from the surface when the first weight plate set is supported and held by the first and second side walls of the cradle in the cradled position.

9. The cradle as set forth in claim 8 wherein each of the first and second end walls comprises a plate-engaging portion and a locking element-engaging portion extending longitudinally inward from the plate engaging portion, the plate-engaging portion of each end wall being shaped and arranged to engage the plate portion of an outermost one of the weight plates in the respective weight plate set and the locking element-engaging portion being shaped and arranged to engage the locking element of the respective outermost one of the weight plates when the free weight assembly is in the cradled position.

10. The cradle as set forth in claim 8 wherein the inboard surfaces of the first and second side walls of each of the first and second cradle brackets are oriented at an angle of between about 25° and about 65° with respect to a vertical axis oriented perpendicular to the longitudinal and lateral axes.

11. The cradle as set forth in claim 8 further comprising a one-piece component that includes the first and second end walls, the first and second side walls, and a base member including the surface.

12. The cradle as set forth in claim 11 wherein the first and second end walls and the first and second side walls are bent upward from the bottom member.

13. The cradle as set forth in claim 12 wherein each of the first and second end walls comprises a plate-engaging portion and a locking element-engaging portion extending longitudinally inward from the plate engaging portion, the plate-engaging portion of each end wall being shaped and arranged to engage the plate portion of an outermost one of the weight plates in the respective weight plate set and the locking element-engaging portion being shaped and arranged to engage the locking element of the respective outermost one of the weight plates when the free weight assembly is in the cradled position, the locking element-engaging portion of each end wall being bent inward along the longitudinal axis from the plate-engaging portion of each end wall.

14. The cradle as set forth in claim 8 in combination with the free weight assembly, the first and second weight plate sets being sized and shaped so that when the free weight assembly is received in the cradle, the first and second weight plate sets are supported by the first and second side walls above the bottom edges of the first and second side walls.

15. The cradle as set forth in claim 8 in combination with a base frame secured to the cradle and supporting the cradle in spaced apart relationship with respect to a surface underlying the base frame.

16. The cradle as set forth in claim 8 in combination with another cradle as set forth in claim 8 configured to support another free weight assembly and a base frame, the base frame being configured to support each of the cradles in spaced apart relationship with one another.

17. The cradle as set forth in claim 8 further comprising a bottom member permanently fixing the first and second side walls relative to one another.

18. The cradle as set forth in claim 14 wherein the first and second weight plate sets are spaced apart from the surface of the cradle underlying the first and second weight plate sets.

19. The cradle as set forth in claim 8 in combination with the free weight assembly.

20. The cradle as set forth in claim 8 wherein each of the first and second side walls provide a laterally extending gap that is arranged for longitudinal alignment with a handle assembly of the free weight assembly.

* * * * *